US009822472B2

(12) United States Patent
Nakajima et al.

(10) Patent No.: US 9,822,472 B2
(45) Date of Patent: Nov. 21, 2017

(54) SEWING MACHINE INCLUDING NEEDLE BAR TURNING APPARATUS

(71) Applicant: Janome Sewing Machine Co., Ltd., Tokyo (JP)

(72) Inventors: Makoto Nakajima, Tokyo (JP); Mikio Koike, Tokyo (JP); Yu Noji, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 88 days.

(21) Appl. No.: 15/138,275

(22) Filed: Apr. 26, 2016

(65) Prior Publication Data

US 2016/0348290 A1 Dec. 1, 2016

(30) Foreign Application Priority Data

May 25, 2015 (JP) ..... 2015-105239
Mar. 11, 2016 (JP) ..... 2016-049031

(51) Int. Cl.
*D05B 3/02* (2006.01)
*D05B 55/14* (2006.01)

(52) U.S. Cl.
CPC ..... *D05B 3/02* (2013.01); *D05B 55/14* (2013.01)

(58) Field of Classification Search
CPC ..... D05B 3/02; D05B 19/14; D05B 55/14
See application file for complete search history.

(56) References Cited

U.S. PATENT DOCUMENTS 2,932,268 A * 4/1960 Johnson ..... D05B 55/14 112/221
3,039,323 A * 6/1962 Mori ..... D05B 19/00 112/444
3,633,527 A * 1/1972 Kasai ..... D05B 19/00 112/159
4,246,855 A * 1/1981 Johnson ..... D05B 3/02 112/221
4,284,016 A * 8/1981 Matumura ..... G05B 19/075 112/453

(Continued)

FOREIGN PATENT DOCUMENTS

JP S60-22921 Y2 7/1985
JP S62-96385 U 6/1987
JP H01-35674 B2 7/1989

*Primary Examiner* — Ismael Izaguirre
(74) *Attorney, Agent, or Firm* — Nakanishi IP Associates, LLC

(57) ABSTRACT

A sewing machine includes a needle bar turning apparatus. The apparatus includes: a needle bar holder swingably held with a fulcrum point as the center of rotation; a swing rod connected to the needle bar holder to transmit a driving force that swings the needle bar holder; a needle bar held by the needle bar holder, which is slidable along the axis and turnable with the axis as the center of rotation, and swingable together with the needle bar holder; a coupling member fixed to the needle bar such that it extends in a direction orthogonal to the needle bar; a guide shaft that extends along the needle bar; and a guide shaft connecting bracket fitted to the coupling member and the guide shaft such that it is movable relative to the coupling member in the coupling member extending direction, and turnable relative to the coupling member with a vertical line extending in the extending direction as the center of rotation.

11 Claims, 33 Drawing Sheets

(56) References Cited

U.S. PATENT DOCUMENTS

| | | | | |
|---|---|---|---|---|
| 4,458,611 | A * | 7/1984 | Arendash | D05B 59/00 112/184 |
| 4,608,937 | A | 9/1986 | Eguchi | |
| 4,768,452 | A * | 9/1988 | Baruffa | D05B 3/02 112/221 |
| 9,605,366 | B2 * | 3/2017 | Koike | D05B 57/32 |

* cited by examiner

SEWING MACHINE INCLUDING NEEDLE BAR TURNING APPARATUS

This application is based on and claims the benefit of priority to Japanese Patent Application No. 2015-105239 filed on May 25, 2015, and Japanese Patent Application No. 2016-049031 filed on Mar. 11, 2016, the contents of which are hereby incorporated by reference in their entirety.

BACKGROUND OF THE INVENTION

Field of the Invention

The present invention relates to a sewing machine including a needle bar turning apparatus.

In a sewing machine configured to be capable of sewing while moving the needle bar dropping position, so as to provide so-called zigzag sewing or the like, a rotating hook configured to rotate at a constant position, i.e., a fixed rotating hook, is employed. With such a sewing machine, the needle dropping position varies with respect to the rotating hook. Thus, the axial direction of the needle opening varies with respect to the rotating hook. This changes the relation between the orientation of a thread loop formed of a thread that passes through the needle opening and an edge of the rotating hook. In some cases, depending on the needle bar dropping position, it is difficult for the thread loop to be caught by the edge of the rotating hook. If the edge of the rotating hook fails to catch the thread loop, such an arrangement is not able to form appropriate stitching.

In order to provide a condition in which the thread loop can be easily caught by the edge of the rotating hook at all times, the needle bar is preferably turned such that the needle opening faces the center of the rotating hook.

Patent document 1 discloses a sewing machine with a so-called "swing" type needle bar swinging mechanism, further including a dedicated mechanism for turning a needle bar.

Also, Patent document 2 discloses a typical configuration of a "pendulum" type needle swinging mechanism.

RELATED ART DOCUMENTS

Patent Documents

[Patent Document 1]

Japanese Examined Patent Publication No. H01-35674

[Patent Document 2]

Japanese Examined Utility Model Application Publication No. S62-96385

The technique disclosed in Patent document 1 relates to a so-called "swing" type needle bar swinging mechanism, configured to swing the needle bar along a cylindrical plane with a rotational axis as a center of rotation. Such a swing type mechanism provides the needle bar with simple motion as compared with that provided by the "pendulum" type needle swinging mechanism described later. Thus, it is relatively easy to further provide such a swing type mechanism with a needle bar turning mechanism as disclosed in Patent document 1, so as to allow the needle to be swung and turned at the same time. However, the "pendulum" type needle swinging mechanism has an advantage in providing a compact-size configuration with a reduced number of components, as compared with a swing type mechanism. At present, there is a demand for a sewing machine having improved functions and a compact size. Accordingly, as a mechanism employed in practical use, such a pendulum type needle swinging mechanism as disclosed in Patent document 2 has become mainstream, instead of a swing type needle swinging mechanism.

However, with the pendulum type needle swinging mechanism disclosed in Patent document 2, the needle bar is swung such that it forms an arc-shaped trajectory along a conical plane. Such an arrangement involves the axis of the needle bar being tilted with respect to the rotational axis of the rotating hook according to the swinging of the needle, as compared with a swing type mechanism, leading to increased complexity of the mechanism. Furthermore, the needle is moved in the vertical direction while there is such tilting. Thus, such an arrangement involves a change in the distance between the needle and the rotational axis of the rotating hook when the needle is moved in the vertical direction, leading to further increased complexity of the mechanism. Such increased complexity of the mechanism becomes a technical difficulty in further providing the needle swinging mechanism with a needle turning mechanism. Conventional techniques have proposed no mechanism that allows a pendulum type needle swinging mechanism to swing and turn a needle using the same power source.

It is a purpose of the present invention to provide a sewing machine including a pendulum type needle swinging mechanism which allows a needle to be turned according to the swinging of the needle.

SUMMARY OF INVENTION

[Aspect 1]

With at least one or more embodiment of the present invention, a sewing machine comprises a needle bar turning apparatus. The needle bar turning apparatus comprises: a needle bar holder held such that it can be swung along a conical plane with a fulcrum point provided to a sewing machine main body as a center of rotation; a swing rod that is connected to the needle bar holder, and that transmits a driving force so as to swing the needle bar holder; a needle bar that is configured as a bar-shaped member, that is held by the needle bar holder such that it can slide along an axis of the bar-shaped member and such that it can turn with the aforementioned axis as a center of rotation, and such that it can be swung together with the needle bar holder; a guide shaft arranged such that it extends along the needle bar; and a needle bar turning portion that is arranged such that one end thereof is fixed to the needle bar and the other end thereof can be turned with the guide shaft as a center of rotation, and that turns the needle bar with the aforementioned axis as a center of rotation according to swinging of the needle bar holder.

[Aspect 2]

With at least one or more embodiment of the present invention, a sewing machine comprises a needle bar turning apparatus. The needle bar turning apparatus comprises: a needle bar holder held such that it can be swung, with a fulcrum point provided to a main body of the sewing machine as a center of rotation; a swing rod that is connected to the needle bar holder, and that transmits a driving force that swings the needle bar holder; a needle bar held by the needle bar holder such that it can be slid in an axial direction thereof and such that it can be turned with an axis thereof as a center of rotation, and configured to be swung together with the needle bar holder; a coupling member that is fixed to the needle bar, and that is arranged such that it extends in a direction that is orthogonal to the needle bar; a guide shaft arranged such that it extends along the needle bar; and a guide shaft connecting bracket fitted to the coupling member and the guide shaft such that it can be moved relative to the coupling member in a direction in which the coupling member extends, and such that it can be turned relative to the coupling member with a virtual line that extends in the extension direction as a center of rotation.

[Aspect 3]

With at least one or more embodiment of the present invention, a sewing machine comprises the needle bar turning apparatus described in the aforementioned aspect 2. Also, the needle bar holder may be configured such that position adjustment can be made for the fulcrum point in a direction in which the swinging central axis extends. Also, a margin may be provided to a fitting portion that connects the coupling member and the guide shaft connecting bracket so as to absorb an angle of tilting that occurs between the guide shaft and the needle bar due to the position adjustment of the fulcrum point.

[Aspect 4]

With at least one or more embodiment of the present invention, a sewing machine comprises the needle bar turning apparatus described in the aforementioned aspect 2 or 3. Also, the needle bar turning apparatus may comprise a needle bar connecting bracket that is engaged with a crank rod that transmits a driving force that drives the needle bar in the axial direction. Also, the needle bar connecting bracket may be arranged such that it is engaged with the coupling member. Also, a margin may be provided to a gap between the needle bar connecting bracket and the needle bar so as to absorb a tilting of the needle bar. Also, the needle bar connecting bracket and the coupling member may be configured such that they do not interfere with each other due to swinging of the coupling member with the guide shaft as a center of rotation.

[Aspect 5]

With at least one or more embodiment of the present invention, a sewing machine comprises a needle bar turning apparatus. The needle bar turning apparatus comprises: a needle bar holder held such that it can be swung with a fulcrum point provided to a sewing machine main body as a center of rotation; a swing rod that is connected to the needle bar holder, and that transmits a driving force so as to swing the needle bar holder; a needle bar that is configured as a bar-shaped member, that is held by the needle bar holder such that it can slide along an axis of the bar-shaped member and such that it can turn with the aforementioned axis as a center of rotation, and that can be swung together with the needle bar holder; a crank rod that transmits a driving force so as to drive the needle bar in the axial direction; a needle bar connecting bracket that is engaged with the crank rod; a needle bar coupling portion that is fixed to the needle bar, that is coupled with the needle bar connecting bracket in a state that allows the needle bar coupling portion and the needle bar to turn with the axis of the needle bar as a center of rotation, and that receives the driving force from the needle bar connecting bracket so as to drive the needle bar in the axial direction; a guide shaft arranged such that it extends along the needle bar; and a needle bar guide portion comprising a fixing portion fixed to the needle bar, and a coupling portion coupled with the guide shaft such that it can be turned with the guide shaft as a center of rotation with a degree of freedom that allows it to relatively tilt with respect to the guide shaft.

[Aspect 6]

With at least one or more embodiment of the present invention, a sewing machine comprises the needle bar turning apparatus described in the aforementioned aspect 5. Also, the coupling portion of the needle bar guide portion may comprise a protruding portion having a semicircular cross-sectional shape, which is coupled with the guide shaft.

[Aspect 7]

With at least one or more embodiment of the present invention, a sewing machine comprises the needle bar turning apparatus described in the aforementioned aspect 5 or 6. Also, the needle bar coupling portion may include at least a portion having a spherical structure. Also, the needle bar connecting bracket may be coupled with the spherical structure of the needle bar coupling portion.

[Aspect 8]

With at least one or more embodiment of the present invention, a sewing machine comprises the needle bar turning apparatus described in the aforementioned aspect 5 or 6. Also, the needle bar coupling portion may be configured as a combination of two ring-shaped members each of which allows the needle bar to be inserted. Also, the needle bar connecting bracket may be arranged between the two ring-shaped members, so as to be engaged with each of the two ring-shaped members.

At least one embodiment of the present invention is capable of providing a sewing machine having a simple configuration that can be designed with a compact size in a simple manner.

DESCRIPTION OF THE PREFERRED EMBODIMENTS

Description will be made with reference to the drawings and the like regarding a best mode for carrying out the present invention.

First Embodiment

Figure 1:
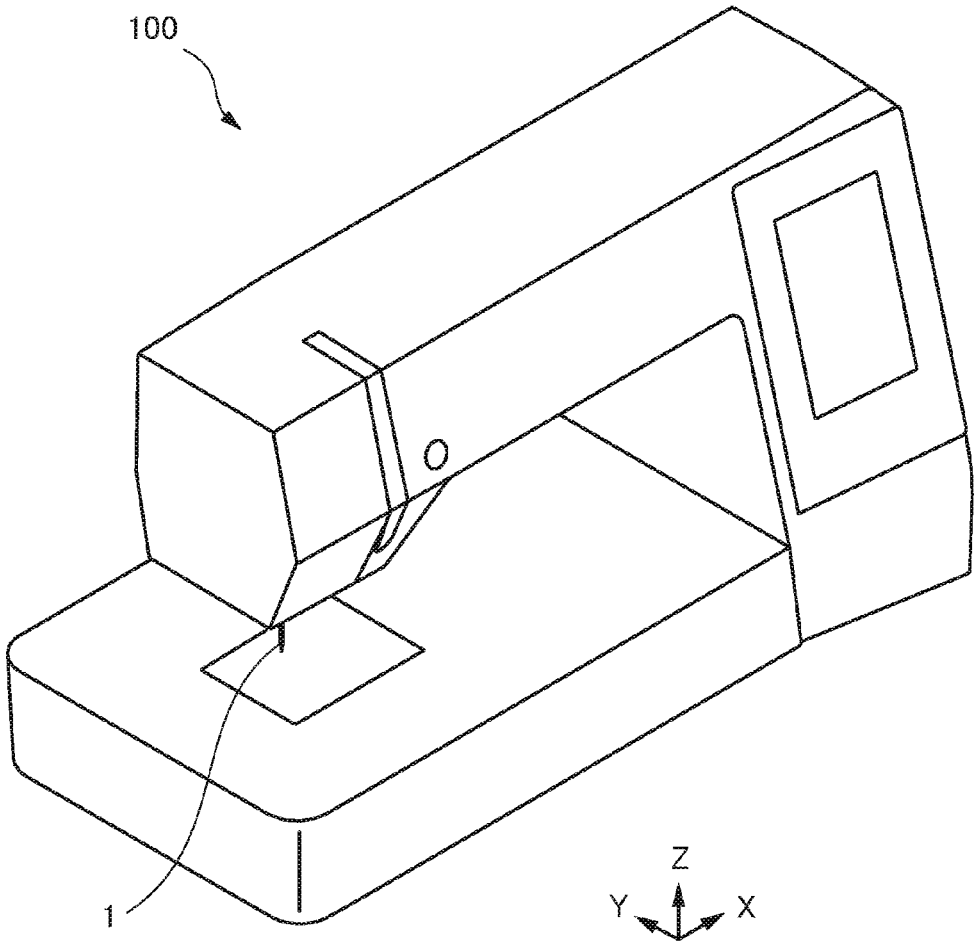
FIG. 1 is a diagram showing an embodiment of a sewing machine 100 including a needle bar turning apparatus according to the present invention.

FIG. 1 is a diagram showing an embodiment of a sewing machine 100 including a needle bar turning apparatus according to the present invention.

Figure 2:
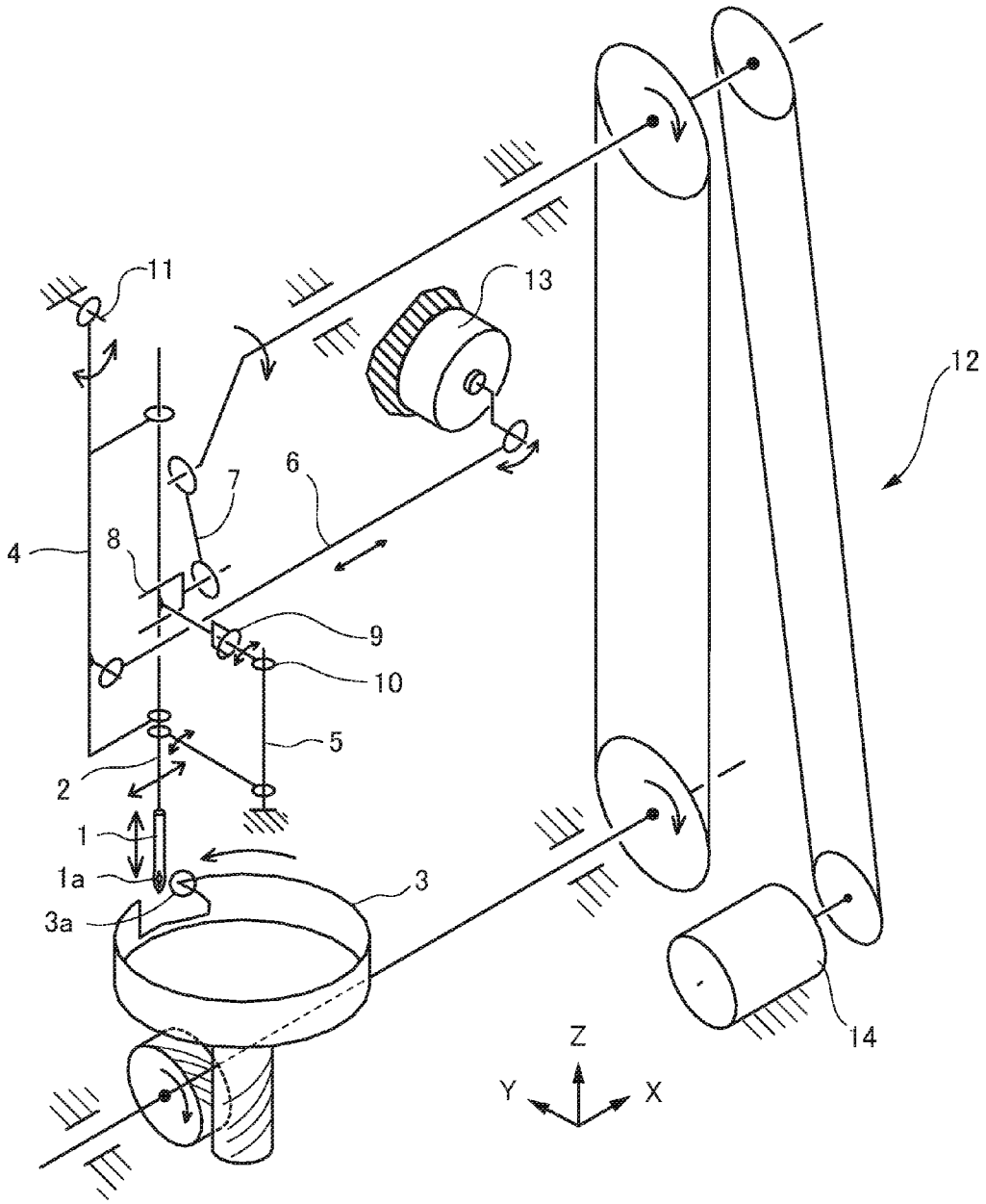
FIG. 2 is a schematic diagram showing a main internal configuration of the sewing machine 100.

FIG. 2 is a schematic diagram showing a main internal configuration of the sewing machine 100.

It should be noted that the drawings including FIGS. 1 and 2 that will be referred in the following description are simplified as appropriate for ease of understanding. Also, the size and the structure of each component are exaggerated as appropriate for ease of understanding.

Also, description will be made below with specific values, structures, materials, and the like, which may be changed as appropriate.

Also, the drawings that will be referred in the following description each show an arrangement in an XYZ orthogonal coordinate system. However, the orientation of such an arrangement shown in each drawing is by no means intended to restrict the configuration of the present invention.

A needle 1 having a needle opening 1*a* is fixed to one end of the needle bar 2. The needle bar 2 is held by the needle bar holder 4 such that it is capable of reciprocating motion in approximately the Z-axis direction.

The needle bar holder 4 is provided such that it can be swung in the manner of a pendulum with a needle bar holder pin 11 as a fulcrum point. A swing rod 6 is connected to the needle bar holder 4.

The swing rod 6 transmits a driving force of a motor 13 in the form of a reciprocating turning movement in a predetermined turning angle range. The swing rod 6 swings the needle bar holder 4.

Furthermore, the needle bar 2 is engaged with a needle bar connecting bracket (needle bar connecting stud) 8 via a coupling member 9.

The coupling member 9 is fixed to the needle bar 2 so as to connect the needle bar 2 with a guide shaft 5. Such an arrangement allows a force to be transmitted to the coupling member 9 so as to turn the needle bar 2.

A crank rod 7 is engaged with the needle bar connecting bracket 8. The needle bar connecting bracket 8 is arranged so as to connect the needle bar 2 and the crank rod 7, and such that the coupling member 9 fixed to the needle bar 2 is interposed between both sides of the needle bar connecting bracket 8. Such an arrangement converts the turning movement of the crank rod 7 into a linear movement of the needle bar in the vertical direction.

The rotational force provided by the motor 14 is transmitted to the crank rod 7 via a transmission mechanism 12. Using this rotational force, the crank rod 7 moves the needle bar connecting bracket 8 in a reciprocating manner in approximately the Z-axis direction.

The coupling member 9 is fixed to the needle bar 2. Furthermore, a guide shaft connecting bracket (guide shaft stud) 10 is engaged with the coupling member 9 as described later.

The guide shaft connecting bracket 10 absorbs the tilting of the coupling member 9, and guides the coupling member 9 such that it is moved in the vertical direction along the guide shaft 5.

The guide shaft 5 is inserted into the coupling member 9 and the guide shaft connecting bracket 10, which form a principal unit of the needle bar turning apparatus according to the present embodiment.

That is, a combination of the coupling member 9 and the guide shaft connecting bracket 10 according to the present embodiment functions as a needle turning unit that turns the needle bar 2 with its axis as the center of rotation according to the swinging of the needle bar holder 4.

The guide shaft 5 functions as a guide member for turning the needle bar 2.

When the needle bar holder 4 is swung, the needle bar 2 also swings together with the needle bar holder 4. With such an arrangement, the coupling member 9 is arranged such that one end thereof is fixed to the needle bar 2, and such that the position of the other end thereof is regulated by the guide shaft 5 together with the guide shaft connecting bracket 10. Thus, the needle bar 2 is turned with its axis as the center of rotation according to the swinging position of the needle bar 2. As a result, the orientation of the needle opening 1*a* of the needle 1 is turned.

Next, description will be made regarding a more specific configuration of the needle bar turning apparatus according to the present embodiment.

Figure 3:
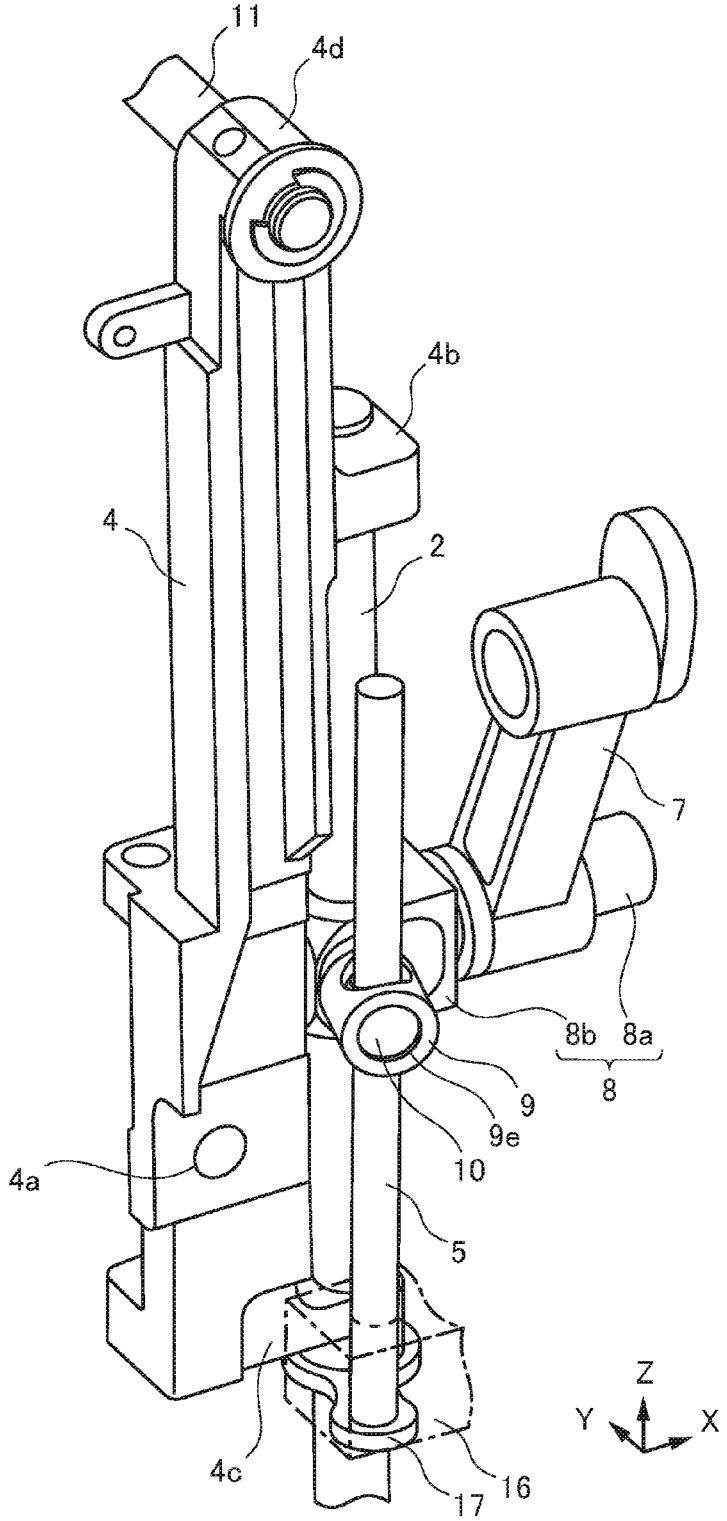
FIG. 3 is a perspective view showing the needle bar turning apparatus in a state in which the needle bar holder 4 and the needle bar 2 swing toward the positive side in the X-axis direction.

FIG. 3 is a perspective view showing the needle bar turning apparatus in a state in which the needle bar holder 4 and the needle bar 2 swing toward the positive side in the X-axis direction.

Figure 4:
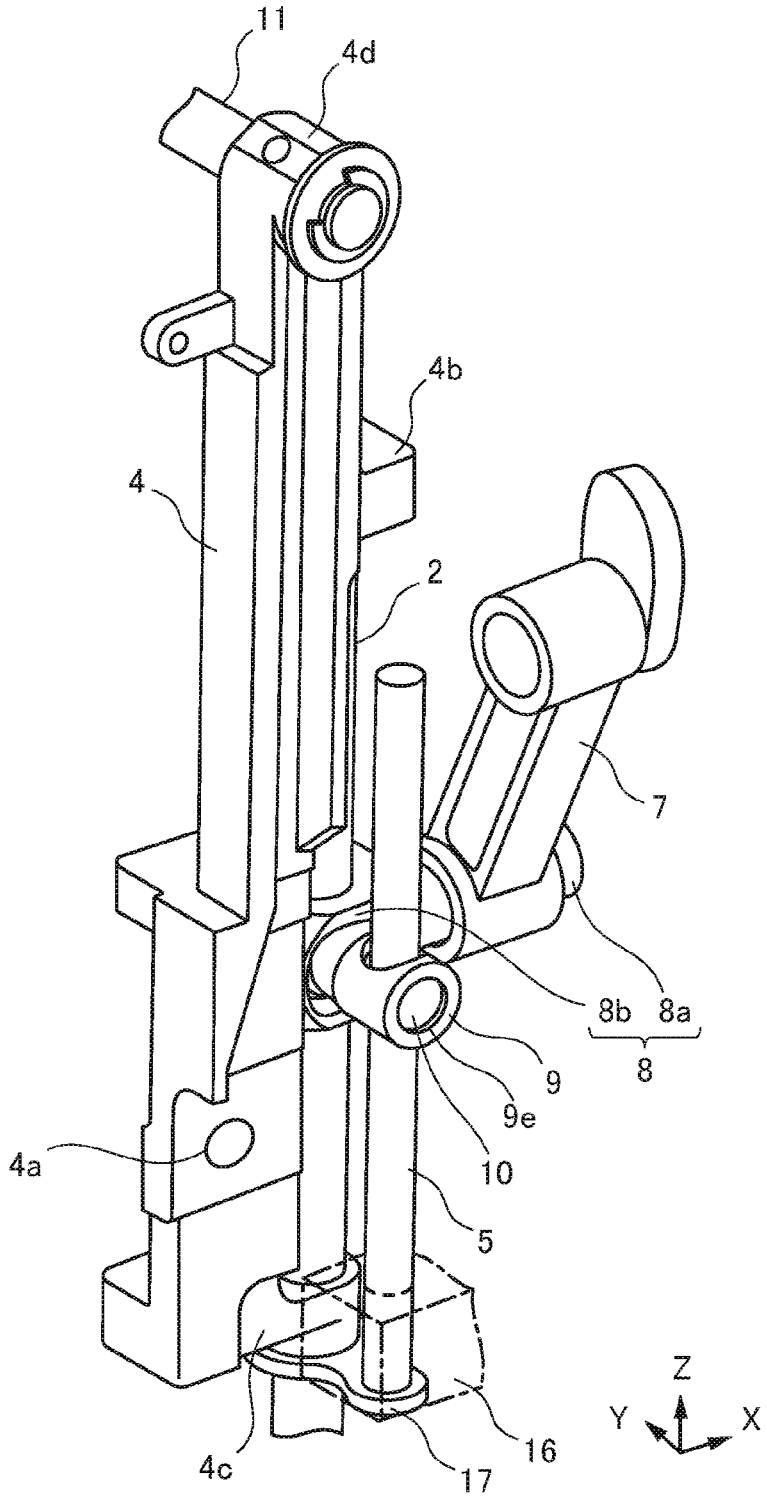
FIG. 4 is a perspective view showing the needle bar turning apparatus in a state in which the needle bar holder 4 and the needle bar 2 are each positioned at a neutral position in the swinging range, i.e., in a state in which they are not swinging.

FIG. 4 is a perspective view showing the needle bar turning apparatus in a state in which the needle bar holder 4 and the needle bar 2 are each positioned at a neutral position in the swinging range, i.e., in a state in which they are not swinging.

Figure 5:
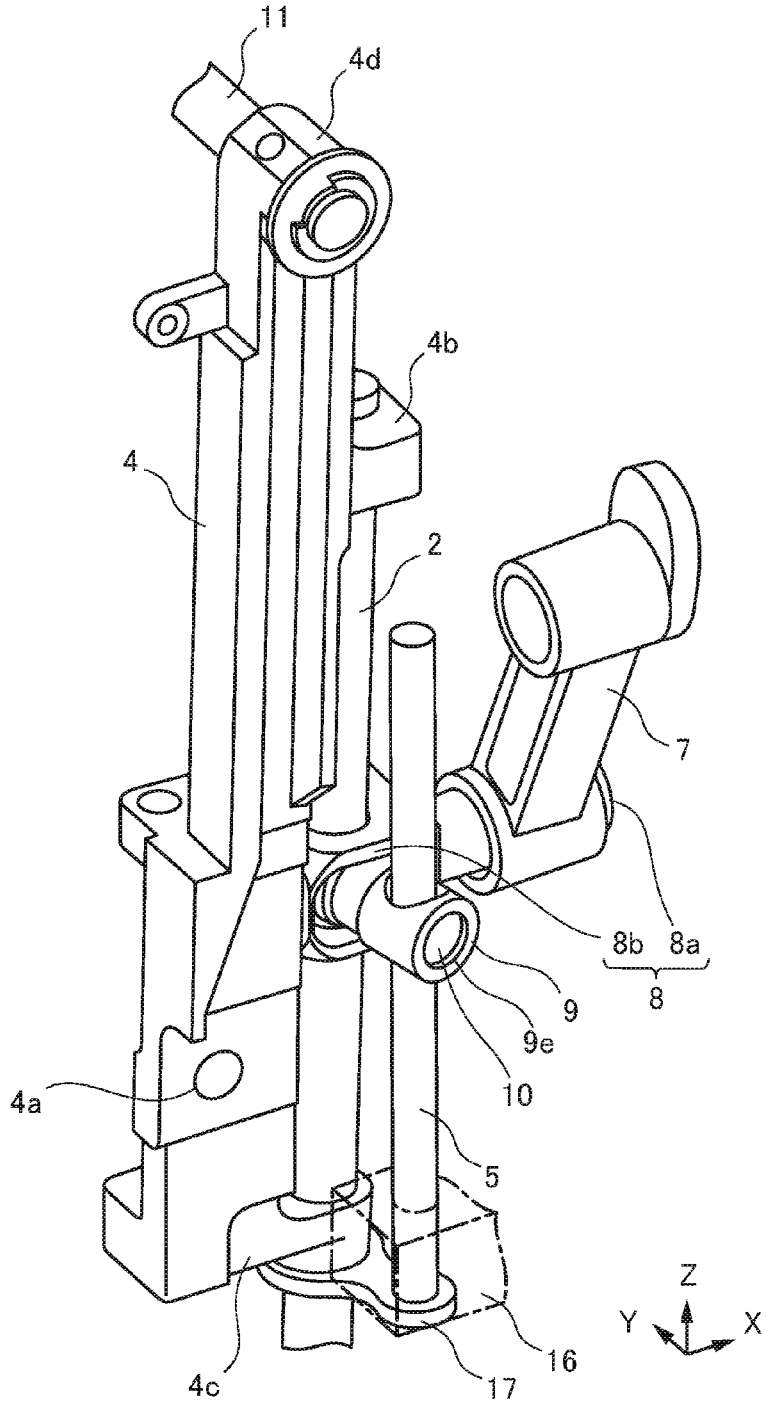
FIG. 5 is a perspective view showing the needle bar turning apparatus in a state in which the needle bar holder 4 and the needle bar 2 swing toward the negative side in the X-axis direction.

FIG. 5 is a perspective view showing the needle bar turning apparatus in a state in which the needle bar holder 4 and the needle bar 2 swing toward the negative side in the X-axis direction.

The needle bar holder 4 is held with a needle bar holder pin 11 provided on an end of the positive side in the X-axis direction as a fulcrum point such that it can be swung in the manner of a pendulum with the fulcrum point thus set as the center of rotation.

A connection hole 4*a* is formed in the needle bar holder 4. The swing rod 6 (see FIG. 2) is connected to the connection hole 4*a*. The swing rod 6 transmits a driving force to the needle bar holder 4 via the connection hole 4*a* so as to swing the needle bar holder 4.

The needle bar holder 4 holds the needle 2 via holding portions 4*b* and 4*c* such that the needle bar 2 can be turned and such that the needle bar 2 can be moved in the axial direction.

The needle bar 2 is held by the needle bar holder 4 such that it can slide in its axial direction and such that it can turn with its axis as the center of rotation. This allows the needle bar 2 to be swung together with the needle bar holder 4. The needle 1 is mounted on a negative side of the needle bar 2 in the Z-axial direction. With the present embodiment, the needle 2 has a pipe-shaped hollow structure (see FIG. 7).

The guide shaft 5 is fixed to a sewing machine main body 16 such that it extends along the needle bar 2. Here, description has been made regarding an arrangement in which the guide shaft 5 is arranged such that it extends along the needle bar 2. However, because the needle bar 2 swings, the guide shaft 5 and the needle bar 2 are not necessarily in parallel with each other.

Figure 6:
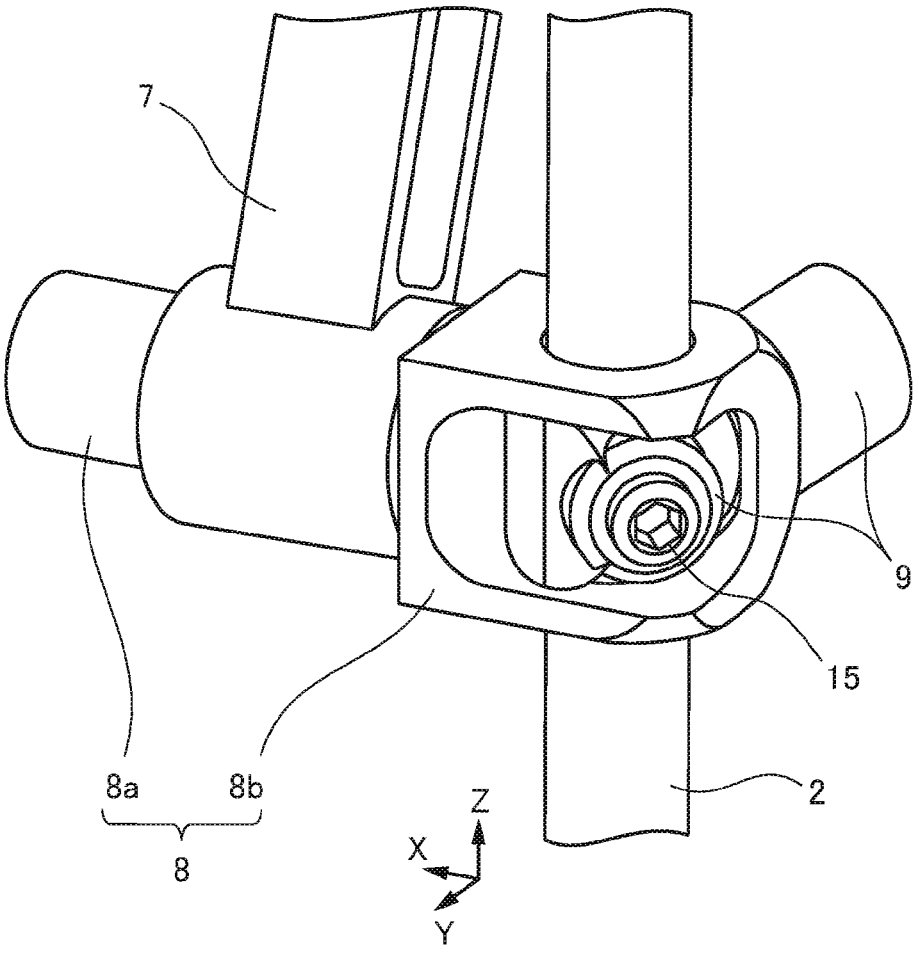
FIG. 6 is a perspective view showing a screw 15 via which the coupling member 9 is fixed to the needle bar 2.

FIG. 6 is a perspective view showing a screw 15 via which the coupling member 9 is fixed to the needle bar 2.

Figure 7:
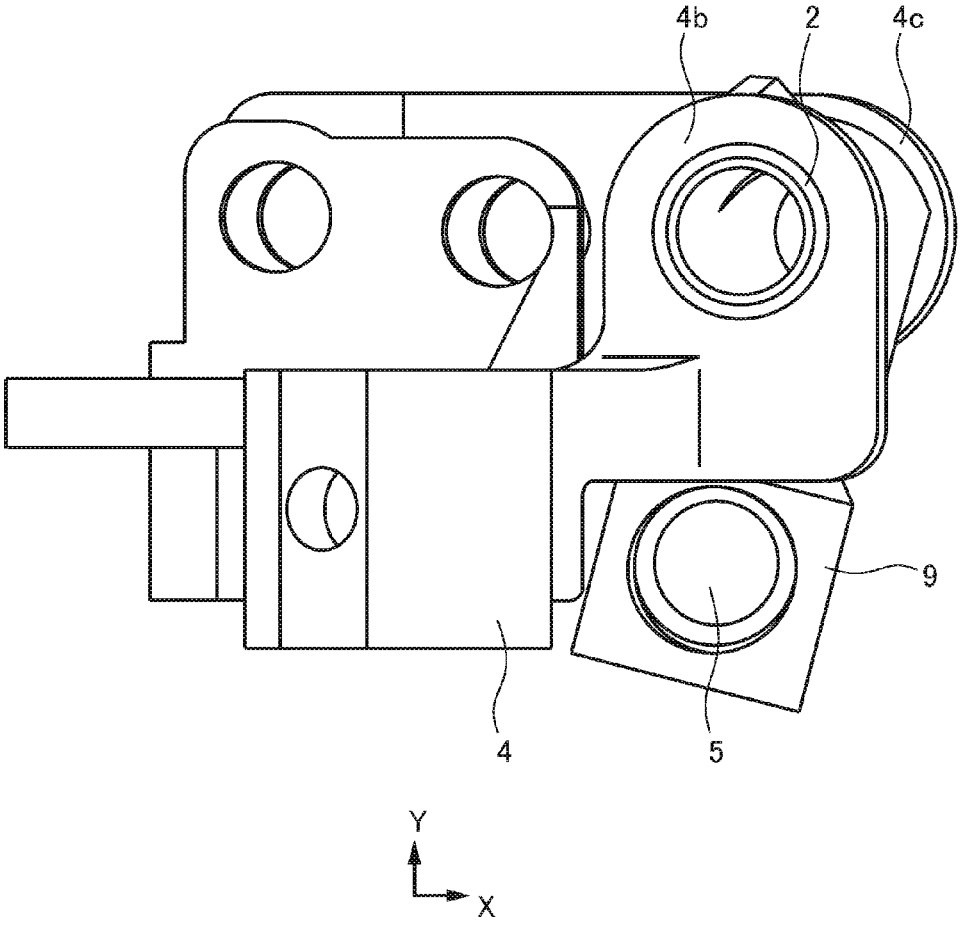
FIG. 7 is a diagram showing the needle bar 2, the needle bar holder 4, the guide shaft 5, and the coupling member 9, as viewed from the positive side in the Z-axis direction.

FIG. 7 is a diagram showing the needle bar 2, the needle bar holder 4, the guide shaft 5, and the coupling member 9, as viewed from the positive side in the Z-axis direction.

Figure 8:
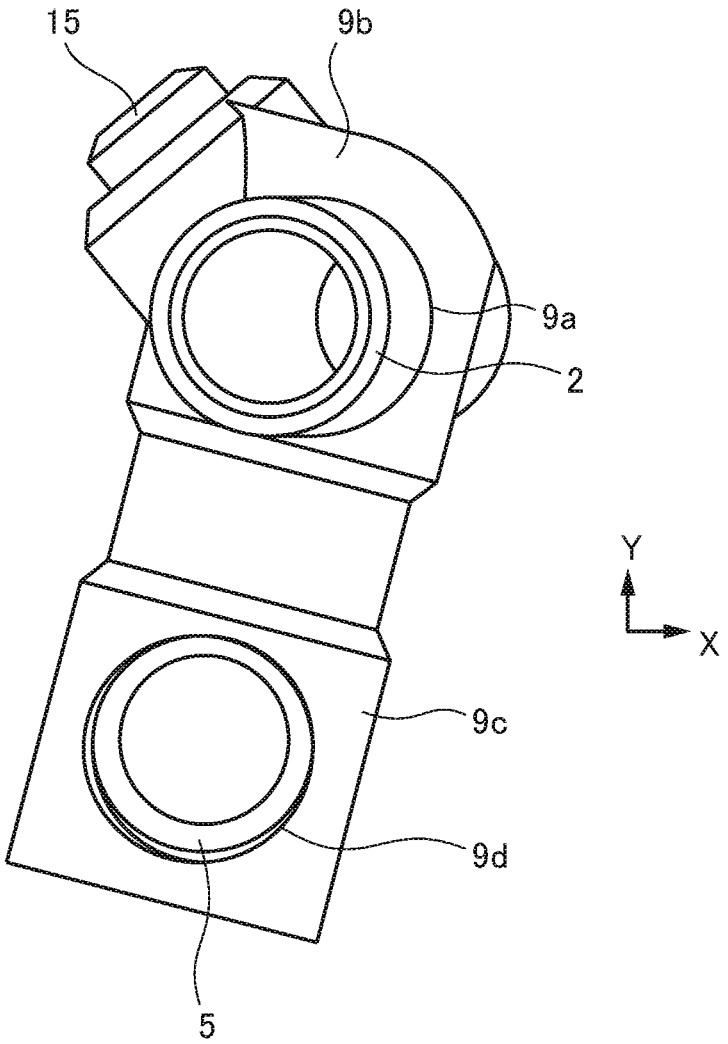
FIG. 8 is a diagram showing the same arrangement shown in FIG. 7 except that the needle bar holder 4 is not shown.

FIG. 8 is a diagram showing the same arrangement shown in FIG. 7 except that the needle bar holder 4 is not shown.

The coupling member 9 has a through opening 9*a*, through which the needle bar 2 passes, formed along the Z axis. The coupling member 9 is arranged such that its base portion 9*b* is fixed by means of a screw 15 to the needle bar 2 at a predetermined position on the needle bar 2.

Furthermore, the coupling member 9 has an extension portion 9*c* configured such that it extends in a direction that is orthogonal to the needle bar 2. The extension portion 9*c* has a through opening 9*d* formed such that it extends in the Z-axis direction. The guide shaft 5 is arranged such that it passes through the opening 9*d*.

Figure 9:
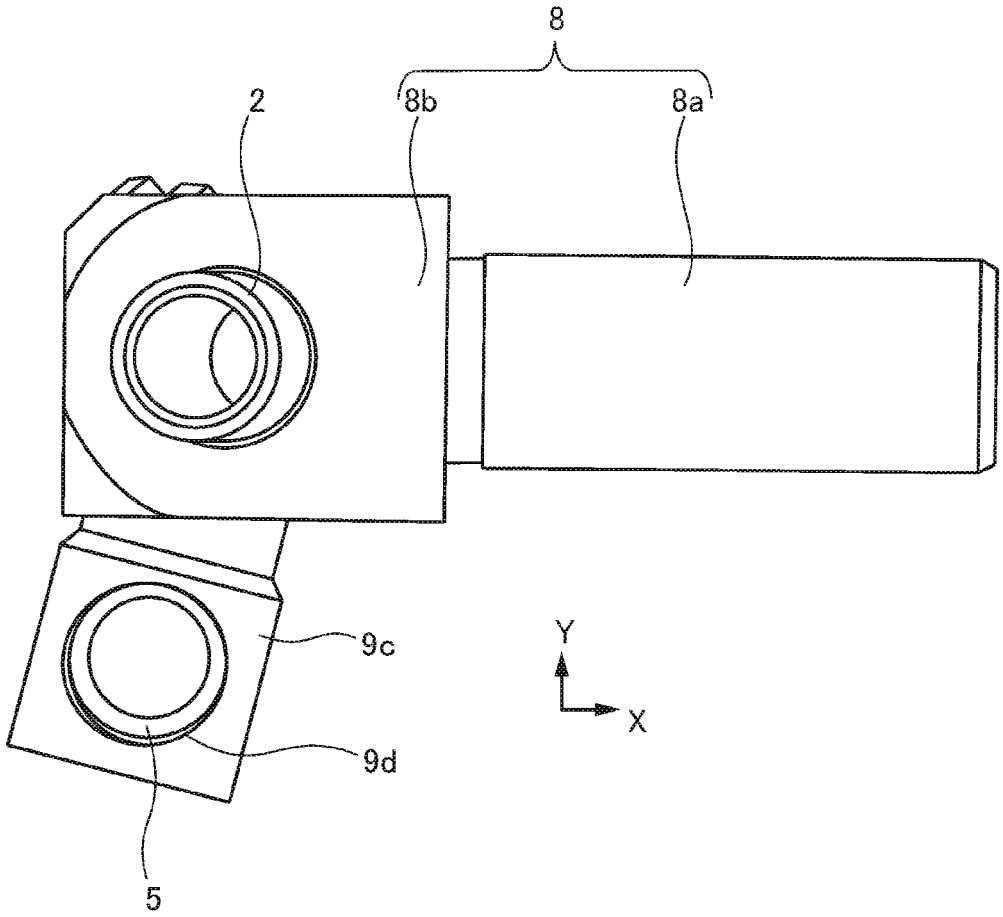
FIG. 9 is a diagram showing the same arrangement shown in FIG. 8 except that the needle bar connecting bracket 8 is also shown.

FIG. 9 is a diagram showing the same arrangement shown in FIG. 8 except that the needle bar connecting bracket 8 is also shown.

Figure 10:
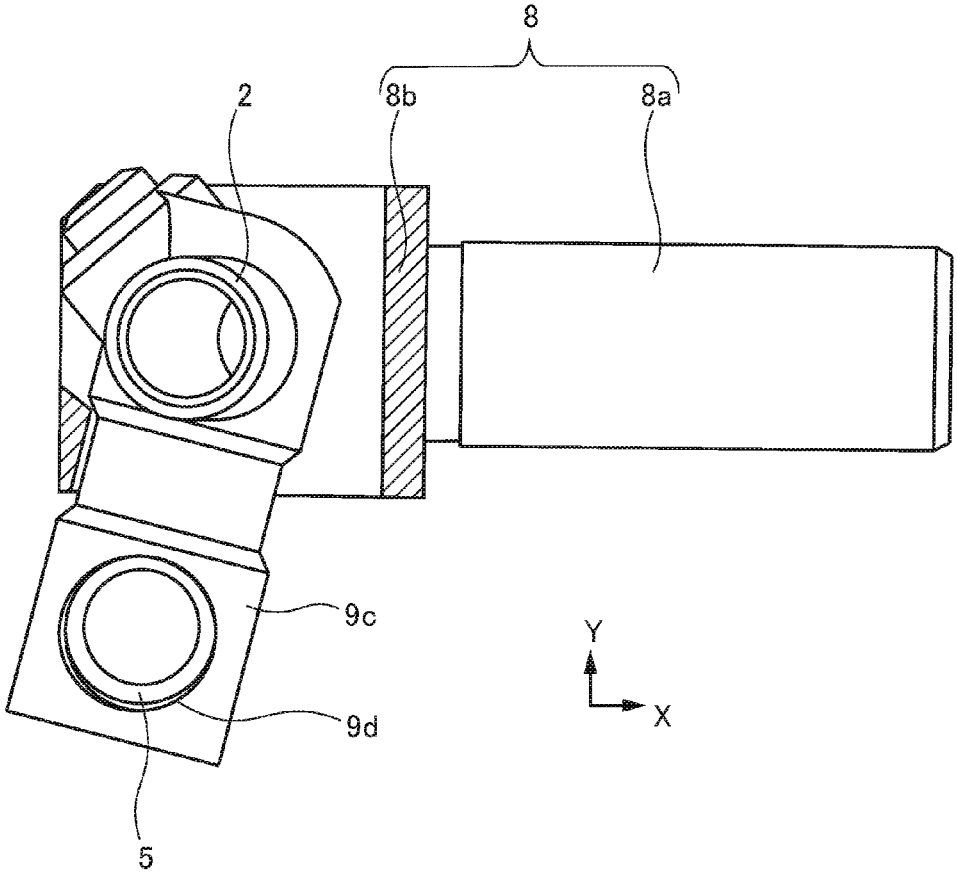
FIG. 10 is a diagram showing the same arrangement shown in FIG. 9 except that the needle bar connecting bracket 8 is shown as a partial cutaway view.

FIG. 10 is a diagram showing the same arrangement shown in FIG. 9 except that the needle bar connecting bracket 8 is shown as a partial cutaway view.

The needle bar connecting bracket 8 includes a shaft portion 8*a* to be connected to the crank rod 7, and a base portion 8*b* for mounting the coupling member 9 such that it is interposed between both sides of the base portion 8*b*. The shaft portion 8*a* is arranged such that it protrudes from the base portion 8*b* toward approximately the positive side in the X-axis direction. Furthermore, the shaft portion 8*a* is inserted into the crank rod 7. The base portion 8*b* is arranged such that the coupling member 9 is interposed between both the upper side and the lower side of the base portion 8*b* in the Z-axis direction. Furthermore, the needle bar 2 is arranged such that it passes through the base portion 8*b*.

When the coupling member 9 is swung, this involves a reduction in the distance between the coupling member 9 and the needle bar connecting bracket 8. Thus, the needle bar connecting bracket 8 and the coupling member 9 are configured such that the two members do not interfere with each other due to the swinging of the coupling member 9 with the guide shaft 5 as a center of rotation.

Figure 11:
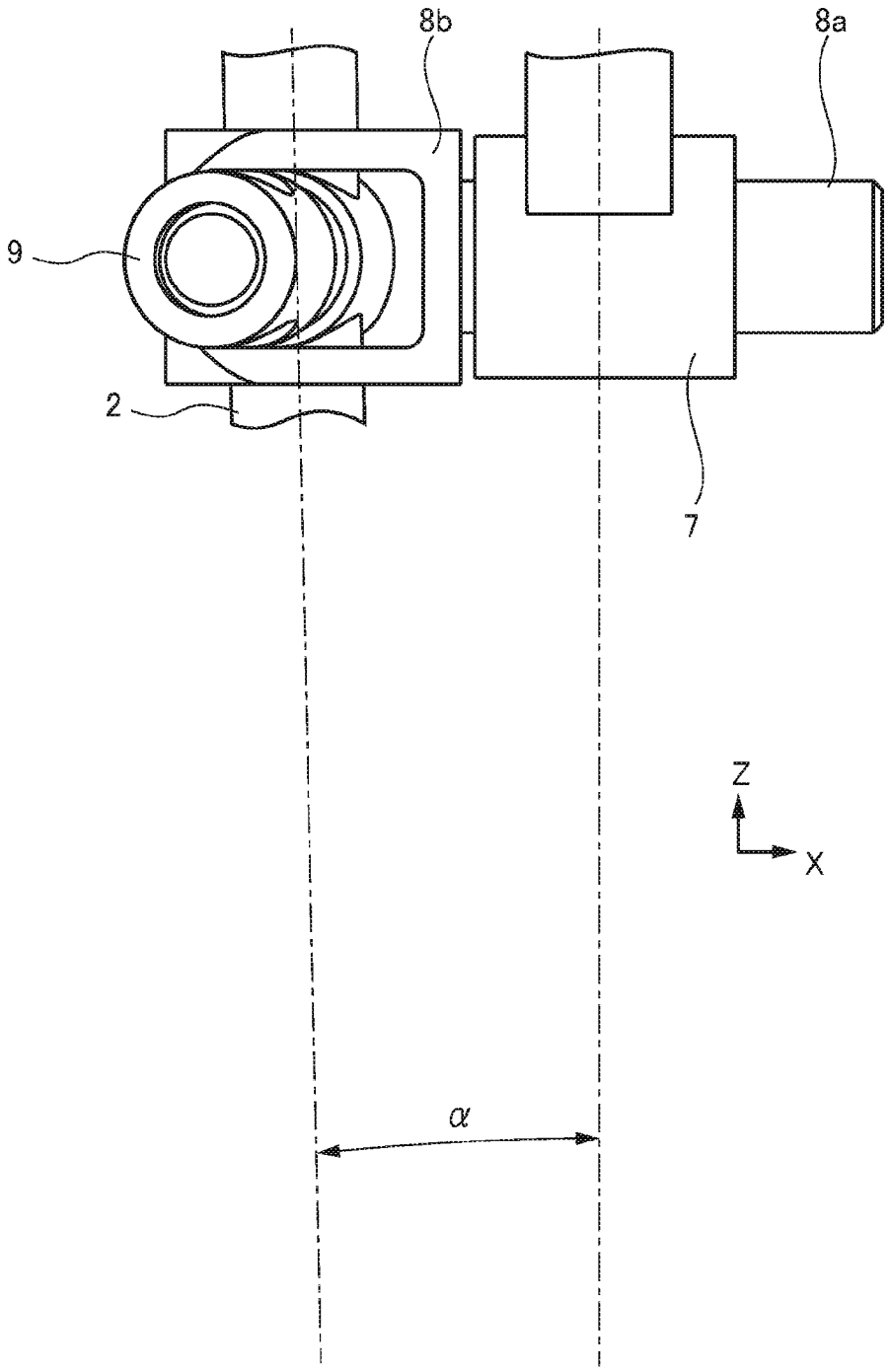
FIG. 11 is a diagram showing the needle bar connecting bracket 8 and the peripheral areas thereof as viewed from the negative side in the Y-axis direction.

FIG. 11 is a diagram showing the needle bar connecting bracket 8 and the peripheral areas thereof as viewed from the negative side in the Y-axis direction.

Figure 12:
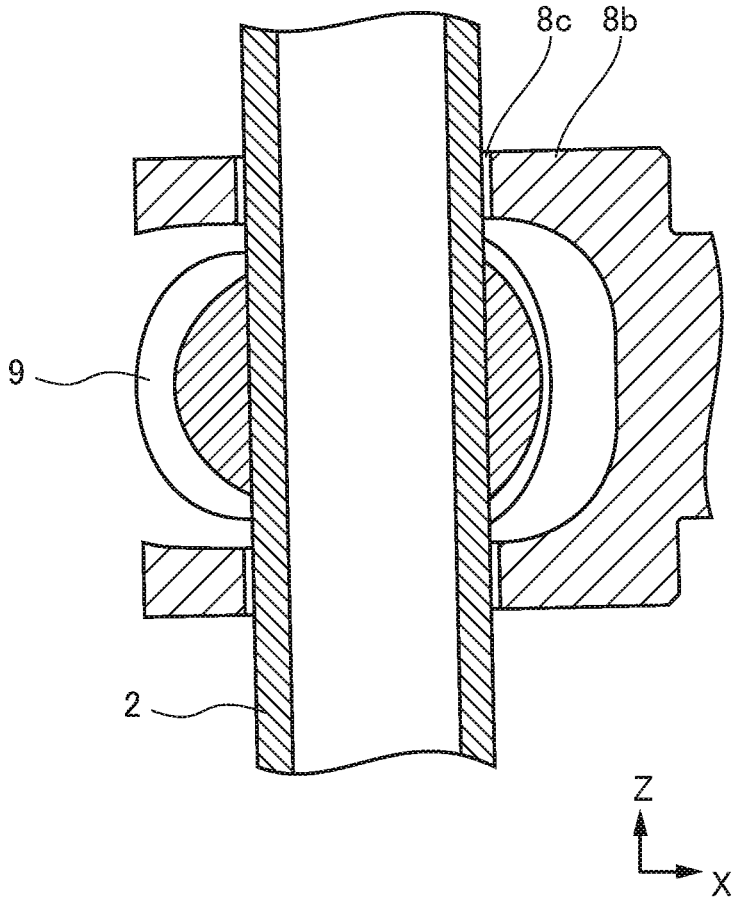
FIG. 12 is an enlarged partial cutaway view of the base portion 8*b* of the needle bar connecting bracket 8 shown in FIG. 11.

FIG. 12 is an enlarged partial cutaway view of the base portion 8*b* of the needle bar connecting bracket 8 shown in FIG. 11.

The relation between the needle bar 2 and the needle bar connecting bracket 8 is such that the needle bar 2 is configured to tilt with respect to the crank rod 7 (angle $\alpha$ in FIG. 11). Thus, the needle bar connecting bracket 8 has a through opening 8*c* having a size that is greater than that of the needle bar 2. The through opening 8*c* is formed to have a minimum size required to absorb the tilting of the needle bar 2, in order to suppress backlash having an effect on the swing of the needle bar 2 while avoiding the through opening 8*c* being bitten by the needle bar 2.

The needle bar connecting bracket 8 is arranged such that its shaft portion 8*a* is orthogonal to the crank rod 7 at all times. Thus, when the needle bar holder 4 is swung, the coupling member 9 fixed to the needle bar 2 is driven such that it is turned with respect to the needle bar connecting bracket 8.

Furthermore, in order to prevent the occurrence of backlash between the needle bar connecting bracket 8 and the coupling member 9 in the Z-axis direction, the coupling member 9 is configured such that it adjoins the needle bar connecting bracket 8 at all times.

Figure 13:
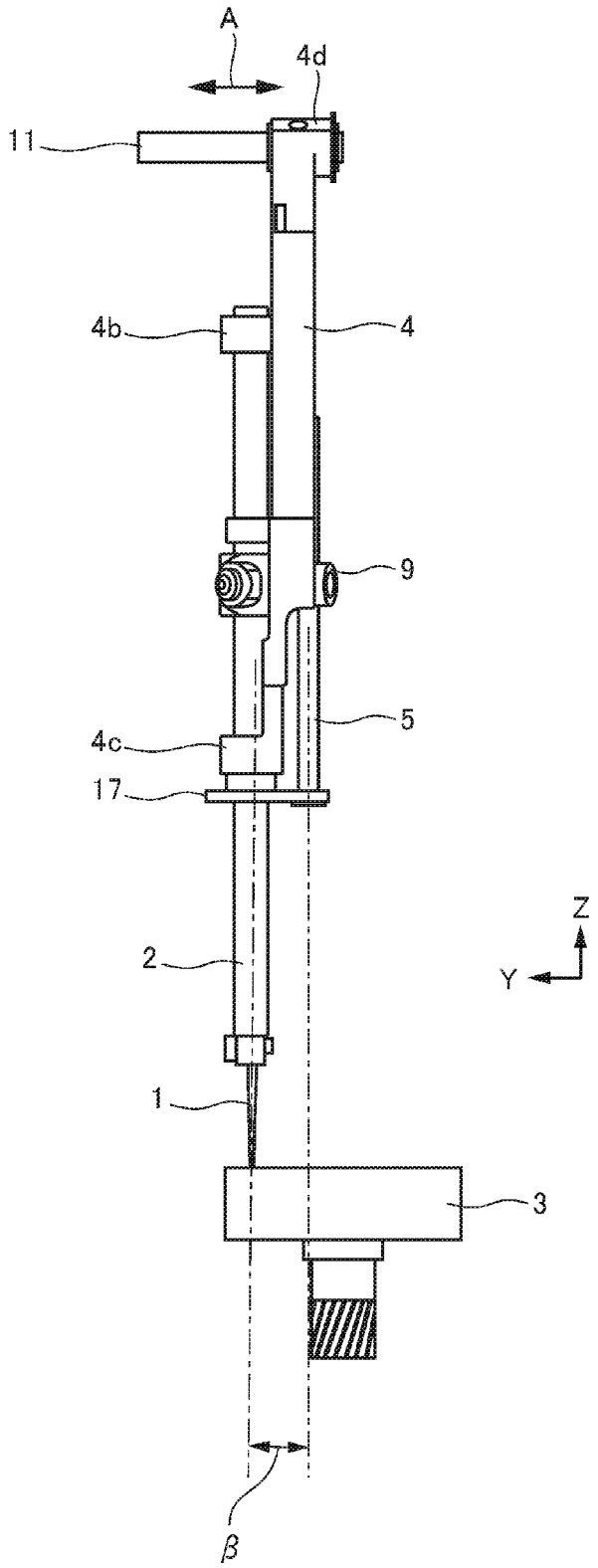
FIG. 13 is a diagram showing the needle bar holder 4 and the peripheral areas thereof as viewed from the negative side in the X-axis direction.

FIG. 13 is a diagram showing the needle bar holder 4 and the peripheral areas thereof as viewed from the negative side in the X-axis direction.

Figure 14:
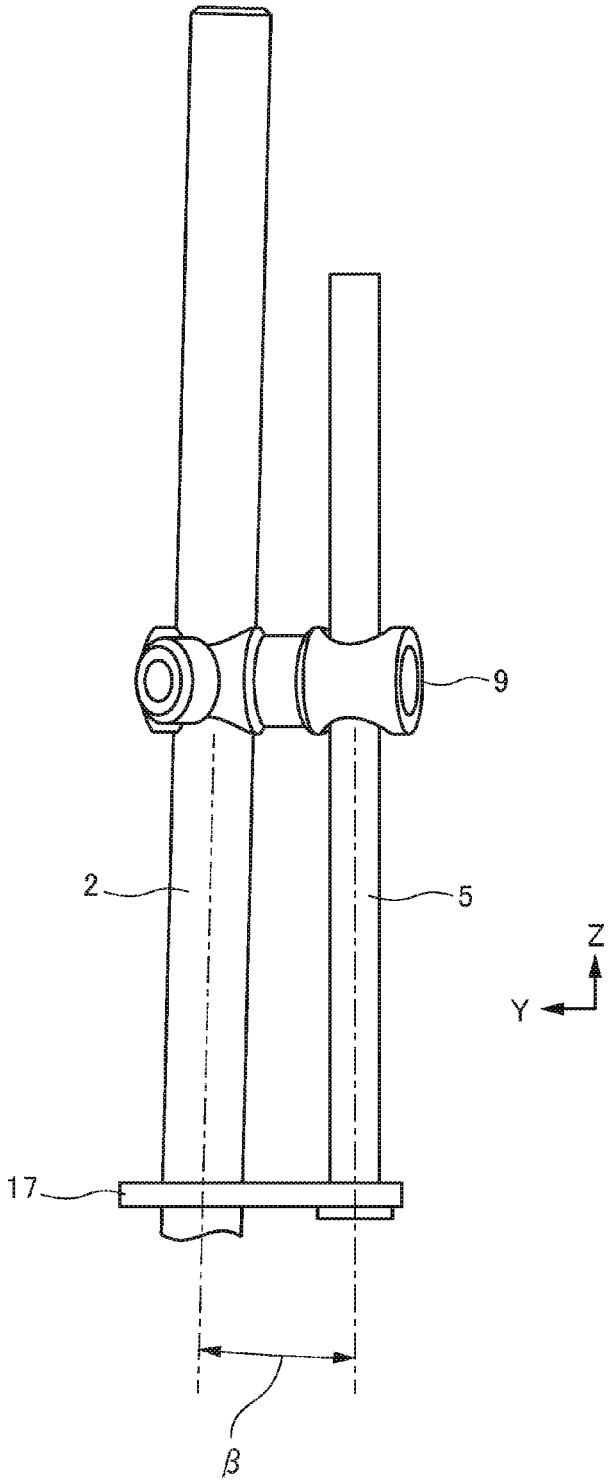
FIG. 14 is an enlarged view of the coupling member 9 in the same state as that shown in FIG. 13.

FIG. 14 is an enlarged view of the coupling member 9 in the same state as that shown in FIG. 13.

A holder guide plate 17 is arranged at one end of the guide shaft 5 on the negative side in the Z-axis direction, so as to connect the guide shaft 5 and the needle bar 2. The holder guide plate 17 is arranged such that the guide shaft 5 passes through one end thereof, and such that the needle bar 2 passes through the other end thereof. The guide shaft 5 and the needle bar 2 are each loosely fitted to the holder guide plate 17 with a gap between them. The holder guide plate 17 appropriately regulates the movement of each of the needle bar 2 and a portion of the needle bar holder 4 on the negative side in the Z-axis direction so as to allow them to swing in a predetermined range with respect to the guide shaft 5.

With a sewing machine including a so-called "pendulum" type needle swinging mechanism as described in the present embodiment, typically, the gap between the needle and the rotating hook is adjusted by shifting the position of the needle bar holder pin 11 in the Y-axis direction (indicated by the double-headed arrow A in FIG. 13). The present embodiment employs the same mechanism.

With the present embodiment, when the gap between the needle 1 and the rotating hook 3 is adjusted, the needle bar holder 4 tilts in the Y-axis direction with the holder guide plate 17 as a fulcrum point. For example, this involves tilting as indicated by the angle β as shown in FIGS. 13 and 14. Accordingly, the needle bar 2 and the guide shaft 5 are not necessarily in parallel with each other.

Thus, the opening 9*d* is formed with a sufficiently large size so as to absorb such tilting that occurs at the coupling member 9, in order to avoid a problem of the guide shaft 5 being bitten by the coupling member 9 due to the aforementioned tilting. That is, a margin is provided to a gap between the guide shaft 5 and the opening 9*d* (see FIG. 15).

Figure 15:
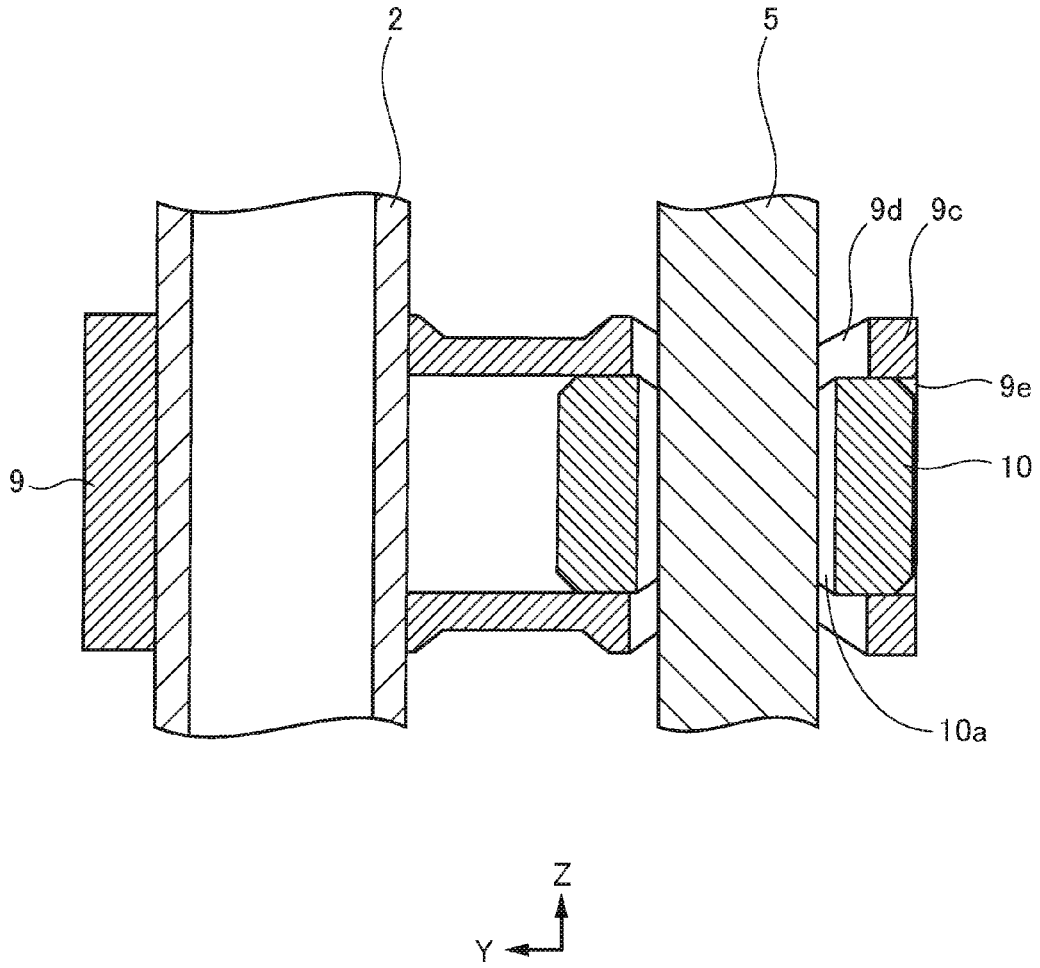
FIG. 15 is a cross-sectional view taken along a line that passes through the peripheral areas of the coupling member 9.

FIG. 15 is a cross-sectional view taken along a line that passes through the peripheral areas of the coupling member 9.

An opening 9*e* is formed in the interior of the extension portion 9*c*. That is, the extension portion 9*c* has a hollow cylindrical structure. The guide shaft connecting bracket 10 is slidably inserted into the opening 9*e*. That is, the guide shaft connecting bracket 10 is fitted to the coupling member 9 and the guide shaft 5 such that it can be moved relative to the coupling member 9 in a direction in which the coupling member 9 extends, and such that it can be turned relative to the coupling member 9 with a virtual line that extends in the extension direction (central axis of the extension portion 9*c*) as the center of rotation.

A slot 10*a* is formed in the guide shaft connecting bracket 10. The guide shaft 5 is arranged such that it passes through and is fitted to the slot 10*a* thus formed. The slot 10*a* is configured to have a major diameter that is greater than the size of the guide shaft 5 in order to prevent a problem of the guide shaft 5 being bitten by the slot 10*a*. That is, a margin is provided to a gap between the guide shaft 5 and the inner wall of the slot 10*a* in the major-diameter direction.

Figure 16:
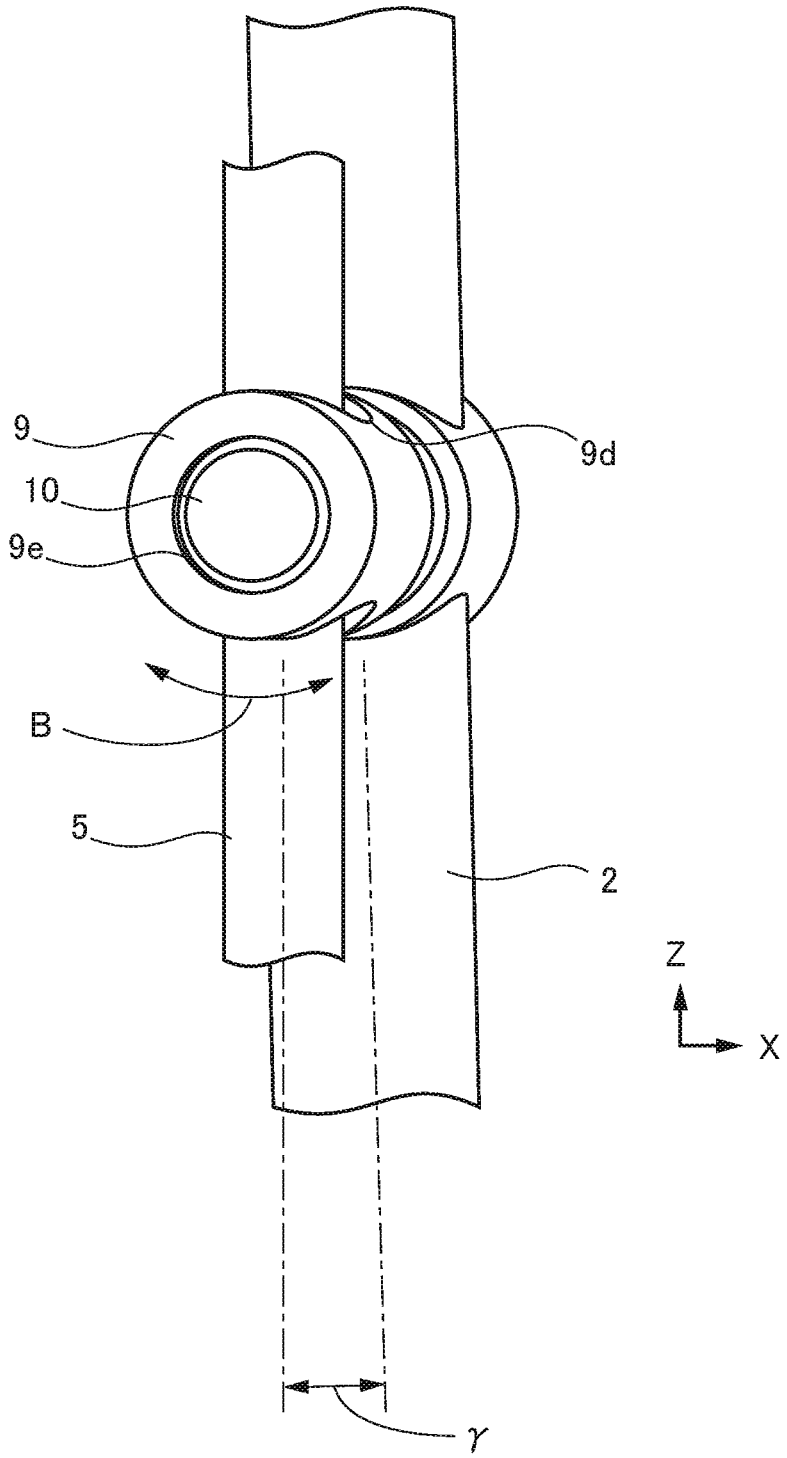
FIG. 16 is a diagram showing the needle bar 2 and the guide shaft 5 as viewed from the negative side in the Y-axis direction.

FIG. 16 is a diagram showing the needle bar 2 and the guide shaft 5 as viewed from the negative side in the Y-axis direction.

Figure 17:
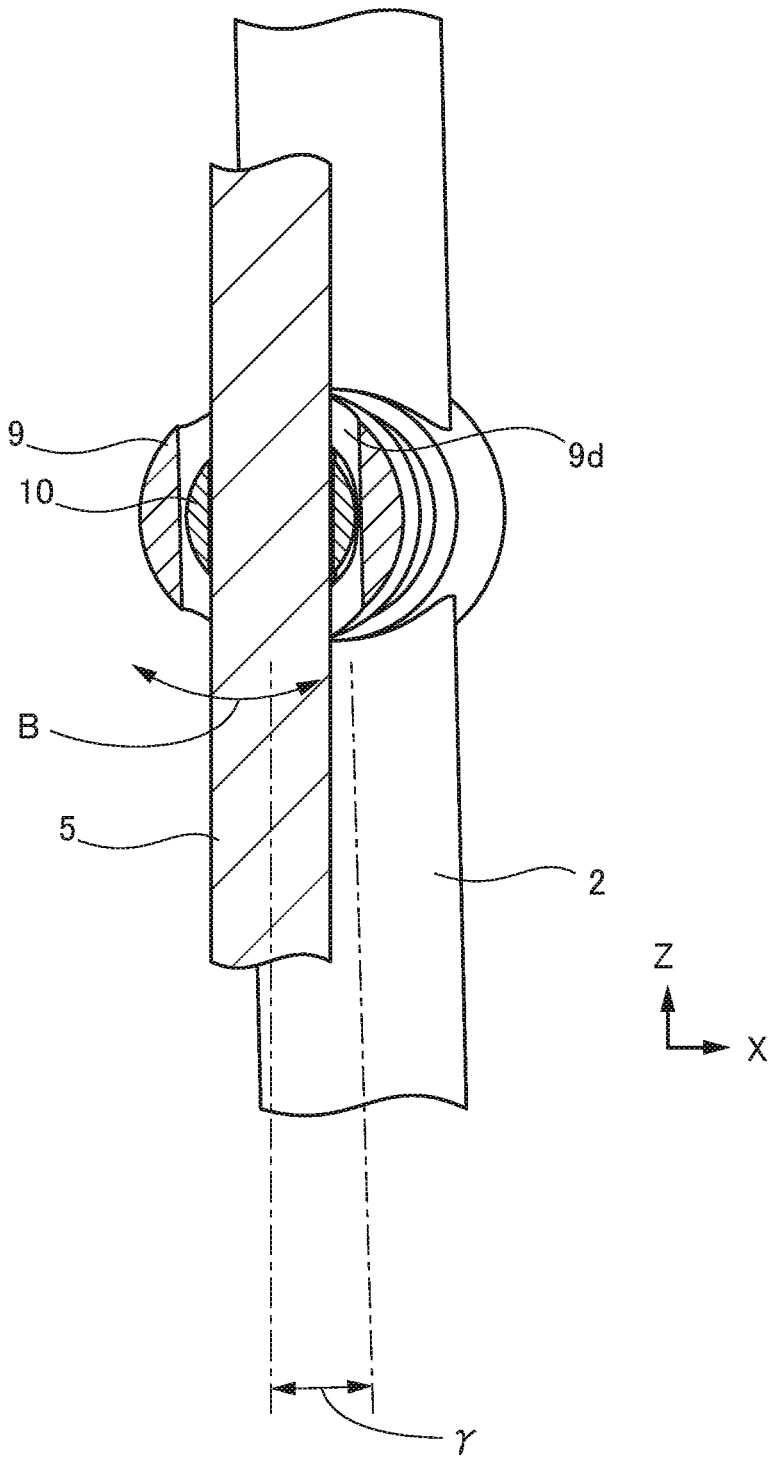
FIG. 17 is a cross-sectional view showing the same arrangement shown in FIG. 16 except that the guide shaft 5 and the peripheral areas thereof are shown as a partial cutaway view.

FIG. 17 is a cross-sectional view showing the same arrangement shown in FIG. 16 except that the guide shaft 5 and the peripheral areas thereof are shown as a partial cutaway view.

When the needle bar holder 4 is swung in the horizontal direction with the needle bar holder pin 11 as a center of rotation, the coupling member 9 is turned with the guide shaft 5 as a center of rotation. With such an arrangement, the coupling member 9 is fixed to the needle bar 2. Accordingly, the coupling member 9 tilts together with the needle bar 2 (angle γ in FIGS. 16 and 17, for example). In order to prevent a problem of the guide shaft 5 being bitten by the coupling member 9 due to the tilting in the swinging direction, as shown in the cross-sectional view, the opening 9*d* is formed in the coupling member 9 to have a size with a margin. That is, a margin is provided to a gap between the opening 9*d* and the guide shaft 5.

Figure 18:
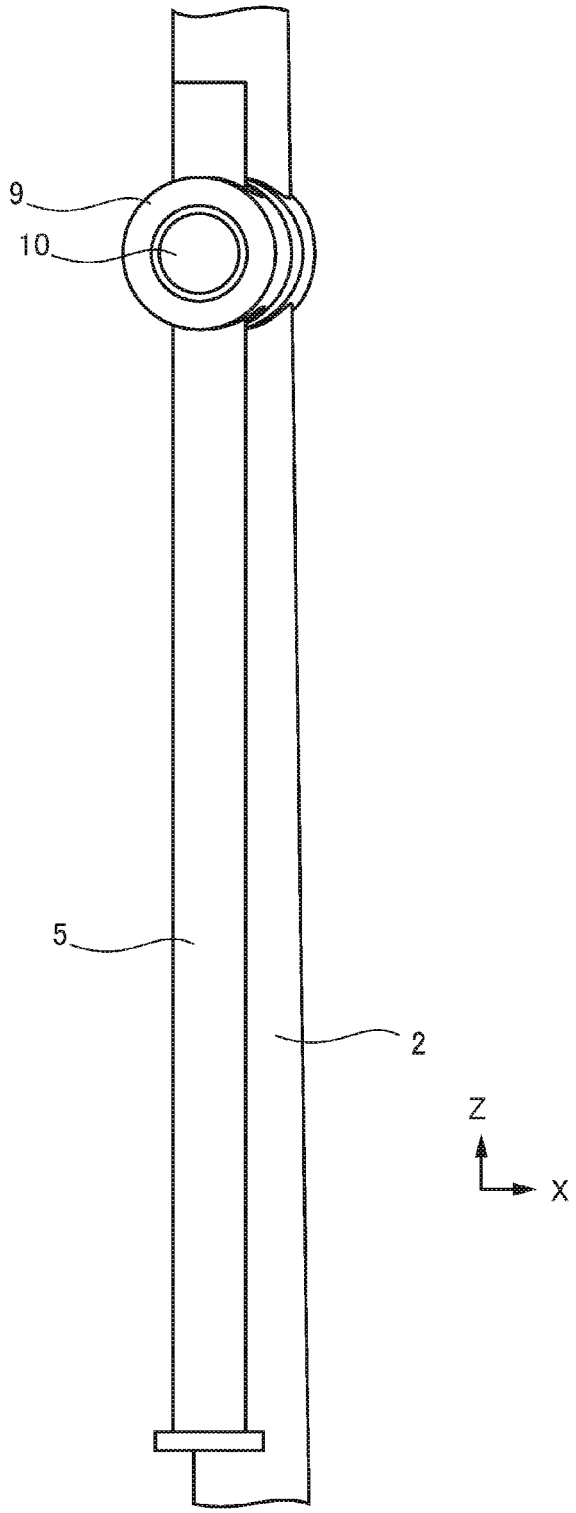
FIG. 18 is a diagram showing a state in which the needle bar 2 is positioned at the top dead center.

FIG. 18 is a diagram showing a state in which the needle bar 2 is positioned at the top dead center.

Figure 19:
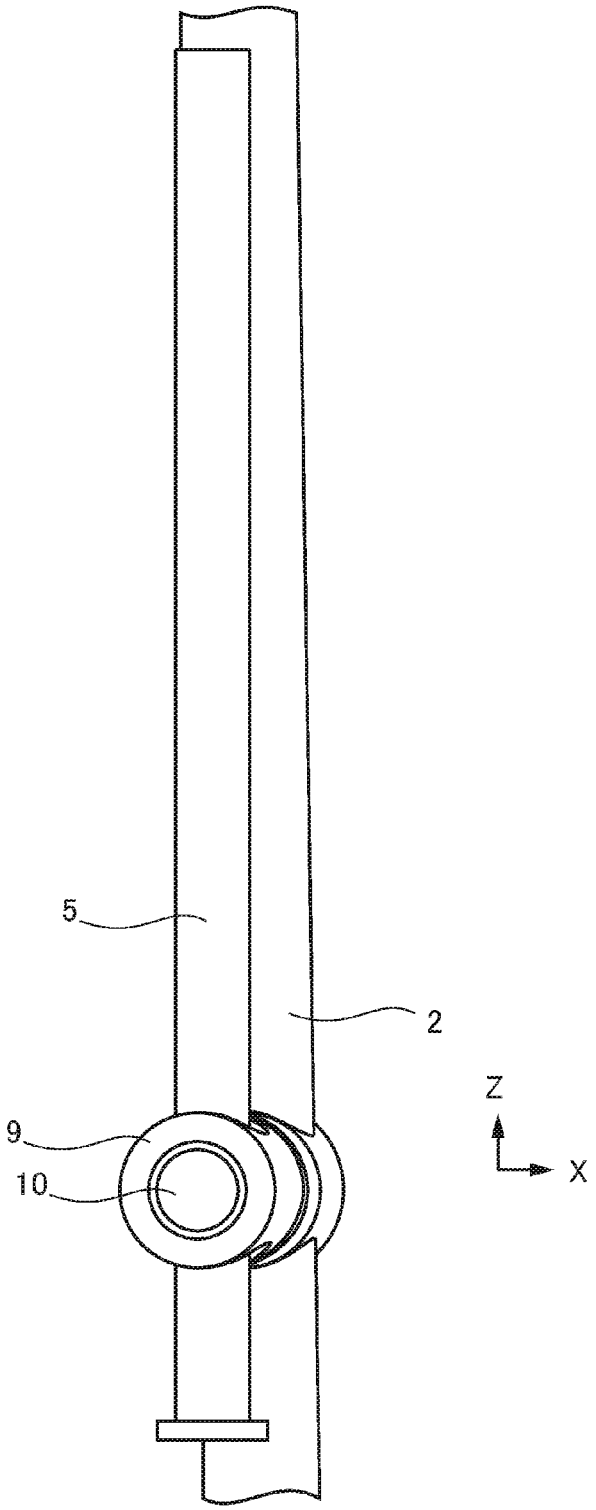
FIG. 19 is a diagram showing a state in which the needle bar 2 is positioned at the bottom dead center.

FIG. 19 is a diagram showing a state in which the needle bar 2 is positioned at the bottom dead center.

Figure 20:
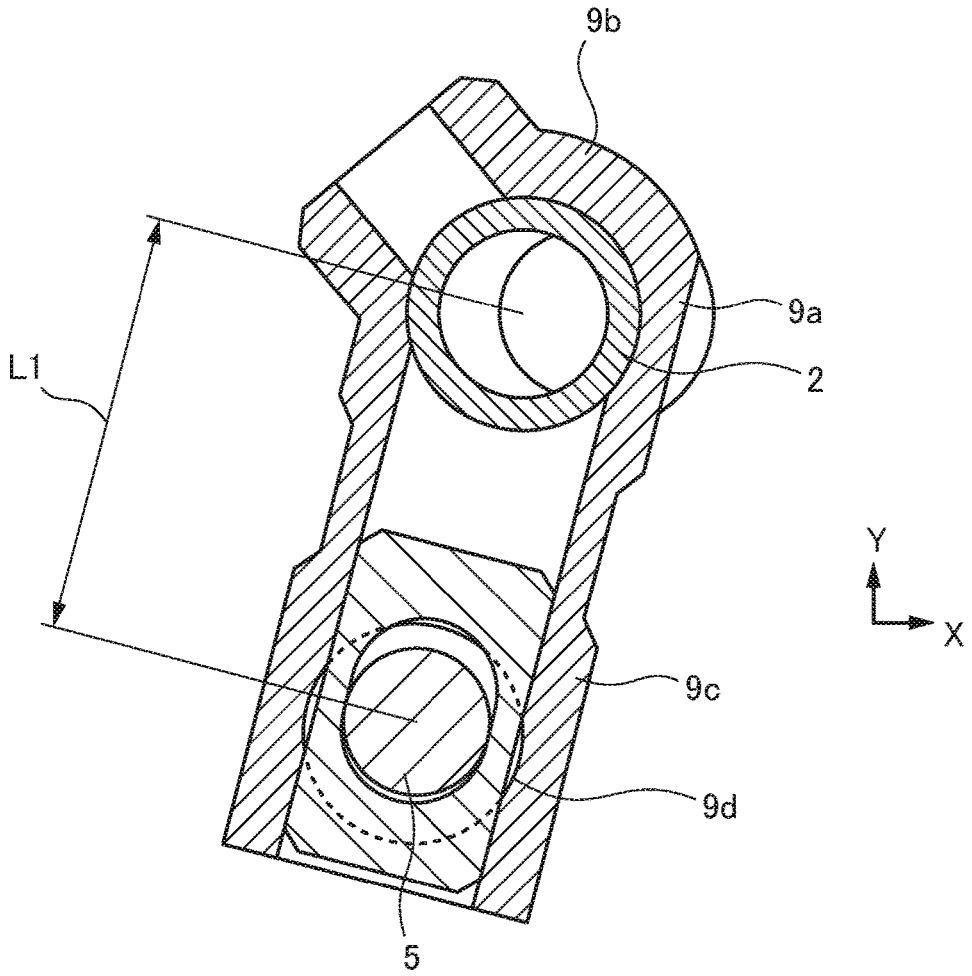
FIG. 20 is a cross-sectional cutaway view showing the coupling member 9 in a state in which the needle bar 2 is positioned at the top dead center.

FIG. 20 is a cross-sectional cutaway view showing the coupling member 9 in a state in which the needle bar 2 is positioned at the top dead center.

Figure 21:
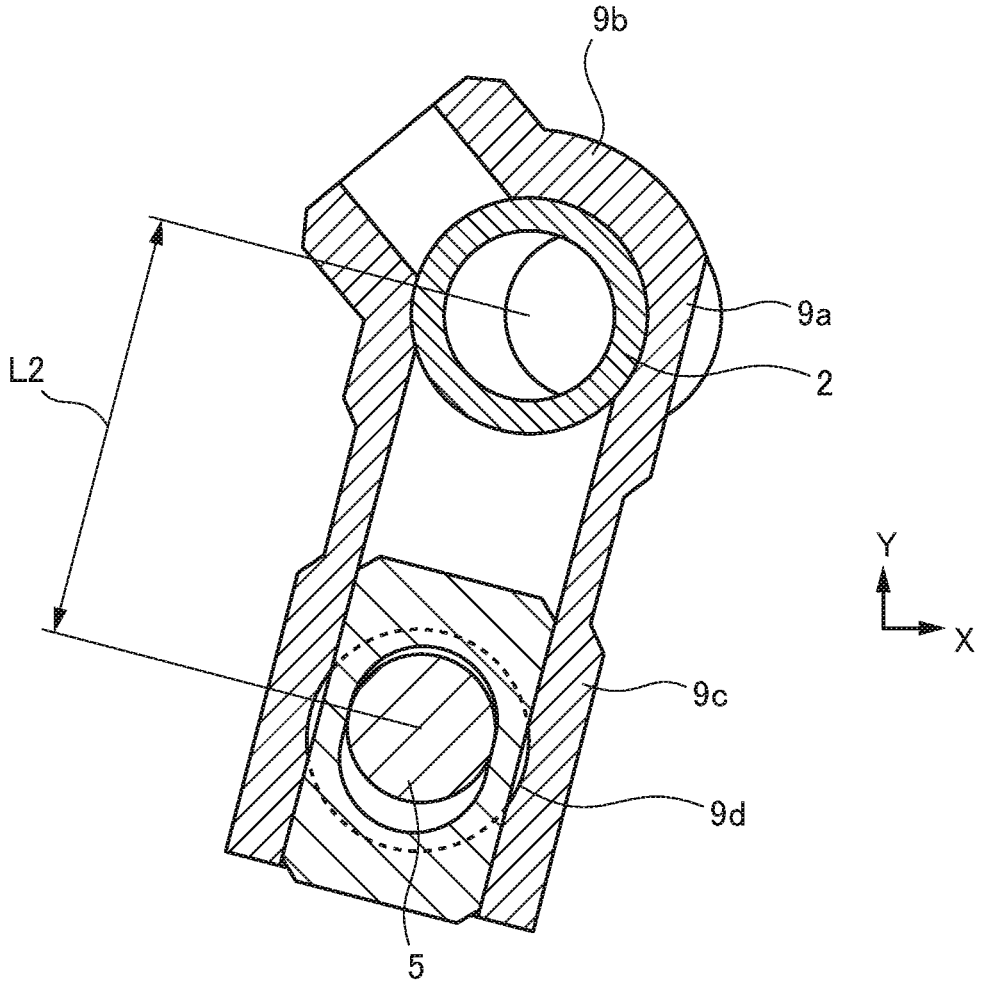
FIG. 21 is a cross-sectional cutaway view showing the coupling member 9 in a state in which the needle bar 2 is positioned at the bottom dead center.

FIG. 21 is a cross-sectional cutaway view showing the coupling member 9 in a state in which the needle bar 2 is positioned at the bottom dead center.

With such a so-called "pendulum" type needle swinging mechanism, such an arrangement does not ensure that the needle bar 2 and the guide shaft 5 are positioned in parallel with each other. Accordingly, when the needle bar 2 is moved in the vertical direction (reciprocating in the Z-axis direction), the axial distance between the needle bar 2 and the wide shaft 5 changes at the position of the coupling member 9 in a range between the distance L1 shown in FIG. 20 and the distance L2 shown in FIG. 21.

Thus, in the present embodiment, the opening 9*d* is designed to have a diameter giving consideration to the change in the axial distance between the needle bar 2 and the guide shaft 5.

With such an arrangement, as described above, the opening 9*d* is formed in the coupling member 9 with a size having a sufficient margin for the guide shaft 5. However, the opening 9*d* having such a large size has the potential to fail to maintain an appropriate relation between the needle bar 2 and the guide shaft 5, leading to an adverse effect on the swinging of the needle bar 2. In order to solve such a problem, in the present embodiment, the guide shaft connecting bracket 10 is provided in the coupling member 9. The guide shaft connecting bracket 10 provides a function of maintaining such an appropriate relation between the needle bar 2 and the guide shaft 5.

As described above, the guide shaft connecting bracket 10 is inserted into the coupling member 9. Furthermore, the guide shaft 5 is inserted into the guide shaft connecting bracket 10. Description has been made above regarding an arrangement in which the slot 10*a* is formed in the guide shaft connecting bracket 10 as an opening into which the guide shaft 5 is to be inserted, thereby preventing a problem of the guide shaft 5 being bitten by the opening due to the tilting as indicated by the angle β shown in FIGS. 13 and 14.

However, in a case in which the slot 10*a* is configured to have an excessively large size, in some cases, this leads to a problem in that an appropriate relation cannot be maintained between the needle bar 2 and the guide shaft 5, as with the aforementioned approach in which the opening 9*d* is formed in the coupling member 9 with a large size. In order to solve such a problem, the slot 10*a* is designed to have a minimum size required to absorb the angle of tilting between the needle bar 2 and the guide shaft 5, i.e., is designed to have a minimum size required to absorb the gap between the needle and the rotating hook 3 to be adjusted. Furthermore, as an approach for absorbing the change in the axial distance between the needle bar 2 and the guide shaft 5, the present embodiment employs a configuration that allows the guide shaft connecting bracket 10 to be shifted in the coupling member 9 in the axial direction.

Also, in a case in which the slot 10*a* is formed to have a large size in another direction so as to absorb the angle of tilting γ shown in FIGS. 16 and 17, in some cases, such an arrangement leads to a problem in that an appropriate relation cannot be maintained between the needle bar 2 and the guide shaft 5. In order to solve such a problem, the slot 10*a* is designed with a minor diameter such that no margin is provided to a gap in this direction between the guide shaft 5 and the guide shaft connecting bracket 10. Instead, the present embodiment employs a configuration in which the guide shaft connecting bracket 10 can be turned in the coupling member 9 in order to absorb the angle of tilting γ shown in FIGS. 16 and 17.

With the sewing machine 100 according to the present embodiment having such a configuration described above, the needle bar holder 4 is swung in the horizontal direction (X-axis direction) in the manner of a pendulum with the needle bar holder pin 11 as a center of rotation, using the driving force provided by the motor 13. Furthermore, the present embodiment is configured to turn the needle bar 2 using the force that swings the needle bar holder 4 in the manner of a pendulum.

In the present embodiment, the coupling member 9 is fixed to the needle bar 2 by means of the screw 15. By fixing the coupling member 9 to the needle bar 2 by means of the screw 15, such an arrangement is configured such that, when the needle bar holder 4 is swung in the X-axis direction, this turns the needle bar 2 with the guide shaft 5 as the center of rotation. That is, such an arrangement is capable of turning the needle bar 2 according to an amount of swinging of the needle bar holder 4.

As described above, the present embodiment employs a so-called "pendulum" type needle swinging mechanism for holding the needle bar 2 configured to turn the needle such that the opening of the needle faces the center of the rotating hook. By configuring a mechanism for holding the needle bar 2 as a so-called "pendulum" type needle swinging mechanism, such an arrangement requires only a single motor as a power source to supply a driving force required to swing and turn the needle bar 2. Furthermore, such an arrangement requires only a single transmission mechanism, i.e., the swing rod. Thus, such an arrangement requires only a very small number of components.

Furthermore, by employing such a "pendulum" type needle swinging mechanism instead of a "swing" type mechanism for swinging all the corresponding components, such an arrangement can be configured to have a compact size, thereby saving space. Furthermore, by allowing such an arrangement to have a compact size, such an arrangement requires only a light load on the motor configured to swing the mechanism. Thus, a compact-size motor can be employed.

With such a "pendulum" type needle swinging mechanism according to conventional techniques, such an arrangement does not ensure that the opening of the needle faces the center of the rotating hook. In contrast, with the present embodiment, the coupling member 9 is mounted to the needle bar 2 in order to ensure that the needle opening 1*a* of the needle 1 faces the center of the rotating hook. Furthermore, the guide shaft 5 is provided as a guide for turning the needle bar 2. With such an arrangement, by guiding the coupling member 9 via the guide shaft 5, such an arrangement is capable of turning the needle bar 2. Such an arrangement allows the sewing machine 100 according to the present embodiment to provide sewing in such a condition that a thread loop can be easily caught by the edge of the rotating hook at all times. Furthermore, as described above, the sewing machine 100 according to the present embodiment can be configured as a sewing machine including a needle bar turning apparatus having a simple configuration that can be easily designed to have a compact size.

Furthermore, with the present embodiment, this provides a sewing machine including a "pendulum" type needle swinging mechanism which is capable of turning a needle bar according to the swing of the needle.

Second Embodiment

Figure 22:
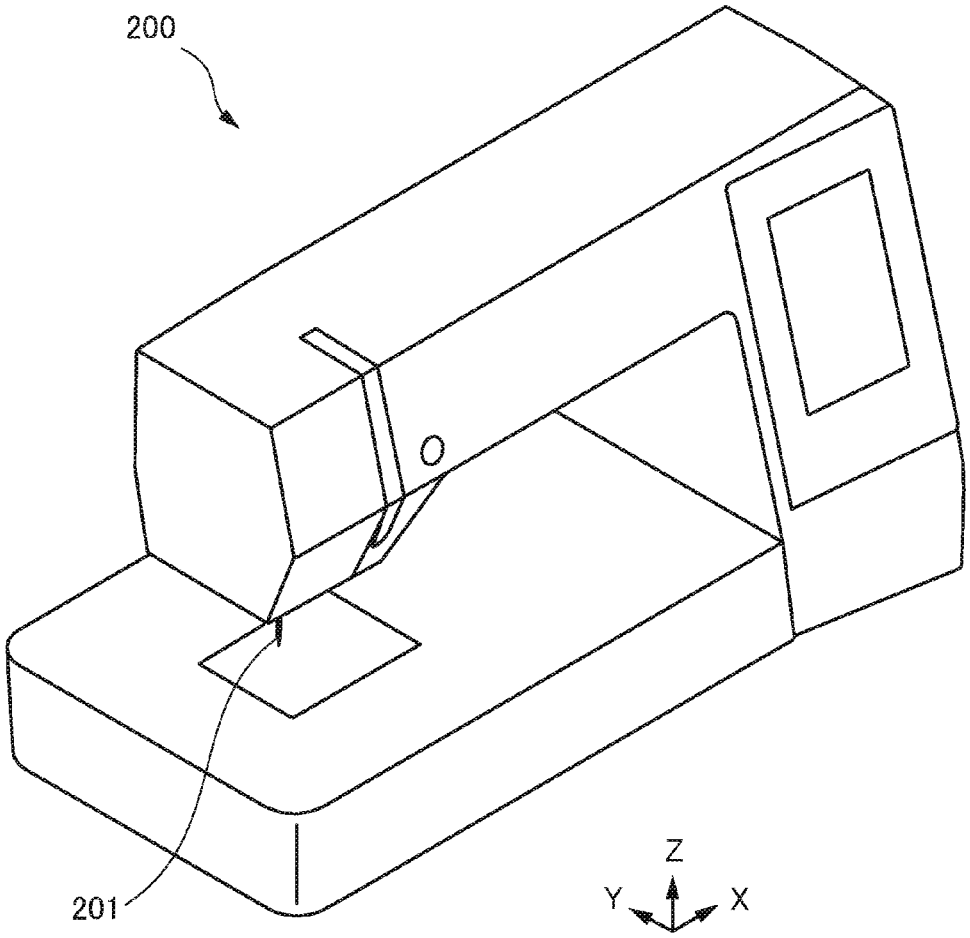
FIG. 22 is a diagram showing a second embodiment of a sewing machine 200 including a needle bar turning apparatus according to the present invention.

FIG. 22 is a diagram showing a second embodiment of a sewing machine 200 including a needle bar turning apparatus according to the present invention.

Figure 23:
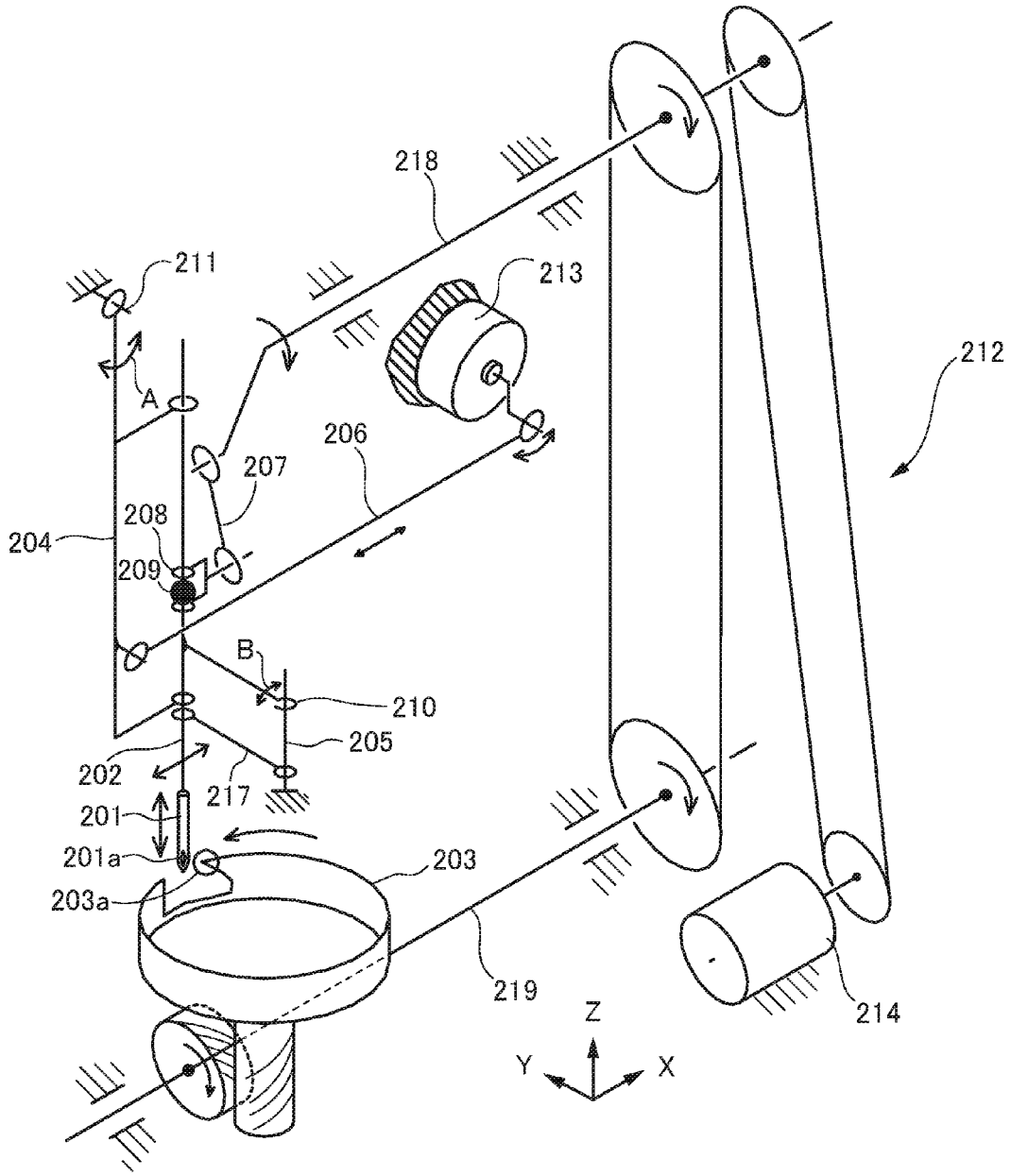
FIG. 23 is a schematic diagram showing a main internal configuration of the sewing machine 200.

FIG. 23 is a schematic diagram showing a main internal configuration of the sewing machine 200.

It should be noted that the drawings including FIGS. 22 and 23 that will be referred in the following description are simplified as appropriate. Also, the size and the structure of each component are exaggerated or omitted as appropriate for ease of understanding.

Also, description will be made below with specific values, structures, materials, and the like, which may be changed as appropriate.

Also, FIGS. 22 and 23 and a part of the drawings that will be referred in the following description each show an arrangement in an XYZ orthogonal coordinate system. The positive side in the X-axis direction is described as the "X positive side". The negative side in the X-axis direction is described as the "X negative side". Also, the sides in the Y-axis direction and the sides in the Z-axis direction will be described in the same manner. However, the orientation of such an arrangement shown in each drawing is by no means intended to restrict the configuration of the present invention.

As shown in FIG. 22, in terms of appearance, the sewing machine 200 according to the present embodiment has the same structure as those according to conventional techniques.

As shown in FIG. 23, a needle 201 having a needle opening 201*a* is fixed to one end of a needle bar 202. The needle bar 202 is configured as a bar-shaped member, which is held by a needle bar holder 204 such that it is capable of reciprocating motion in its axial direction (in approximately the Z-axis direction).

The needle bar holder 204 is provided such that it can be swung in the manner of a pendulum with a needle bar holder pin 211 as a fulcrum point. A swing rod 206 is connected to the needle bar holder 204.

A driving force is transmitted to the swing rod 206 from a motor 213 in the form of a reciprocating turning movement in a predetermined turning angle range. The swing rod 206 swings the needle bar holder 204. Thus, a force is applied to the needle bar holder 204 such that it is swung in the direction indicated by the arrow A shown in the drawing.

Furthermore, the needle bar 202 is coupled with a needle bar connecting bracket 208 via a needle bar coupling portion 209.

The needle bar coupling portion 209 is fixed to the needle bar 202. Furthermore, the needle bar connecting bracket 208 is coupled with the needle bar coupling portion 209 thus fixed to the needle bar 202 such that it can be turned with the axis of the needle bar 202 as the center of rotation. Thus, the needle bar connecting bracket 208 does not regulate the turning of the needle bar 202 with its axis as the center of rotation. Furthermore, the needle bar coupling portion 209 receives a driving force from the needle bar connecting bracket 208 so as to drive the needle bar 202 in its axial direction.

A crank rod 207 is engaged with the needle bar connecting bracket 208. The needle bar connecting bracket 208 connects the needle bar 202 and the crank rod 207 such that the needle bar coupling portion 209 fixed to the needle bar 202 is interposed between both sides of the needle bar connecting bracket 208. Such an arrangement allows the rotation of an upper shaft 218 to be transmitted to the needle bar 202 in the form of a linear movement in the vertical direction.

The rotational force provided by the motor 214 is transmitted to the crank rod 207 via a transmission mechanism 212. Using this rotational force, the crank rod 207 moves the needle bar connecting bracket 208 in a reciprocating manner in approximately the Z-axis direction.

Furthermore, the needle bar 202 is fixed to one side of a needle bar guide plate 210 (needle bar guide member). The other side of the needle bar guide plate 210, which is opposite to the side that is fixed to the needle bar 202, is coupled with a guide shaft 205 such that it can be turned with the guide shaft 205 as the center of rotation with a degree of freedom that allows it to be relatively tilted with respect to the guide shaft 205. The needle bar guide plate 210 according to the present embodiment functions as a needle bar turning portion that turns the needle bar 202 with its axis as the center of rotation according to the swinging of the needle bar holder 204.

Furthermore, a holder guide plate 217 is provided to the needle bar 202 on the negative side in the Z-axis direction at a distance from the needle bar guide plate 210 along the axis of the needle bar 202. The holder guide plate 217 connects the guide shaft 205 and a holding portion 204*b* of the needle bar holder 204.

The holder guide plate 217 regulates the swinging of the needle bar 202 within an arc-shaped range with the guide shaft 205 as the center of rotation as indicated by the arrow B. Accordingly, the needle bar 202 is configured to swing such that it forms an arc-shaped trajectory along a conical plane defined by the swinging indicated by the arrow A and the swinging indicated by the arrow B (see FIG. 29 described later).

The guide shaft 205 functions as a guide member configured to allow the needle bar 202 to be turned.

When the needle bar holder 204 is swung, the needle bar 202 also swings together with the needle bar holder 204. With such an arrangement, one end of the needle bar guide plate 210 is fixed to the needle bar 202, and the other end side thereof is engaged with the guide shaft 205. Thus, the needle bar 202 is turned with its axis as the center of rotation according to the swinging position. This turns the orientation of the needle opening 201*a* of the needle 201.

A rotating hook 203 is provided with an edge 203*a*. The rotating hook 203 is rotated using the rotation of a lower shaft 219 configured to rotate in synchronization with the upper shaft 218. In this state, the edge 203*a* catches a thread loop formed by a thread that is passed through the needle opening 201*a*.

Next, more specific description will be made regarding a configuration of the needle bar turning apparatus according to the present embodiment.

Figure 24:
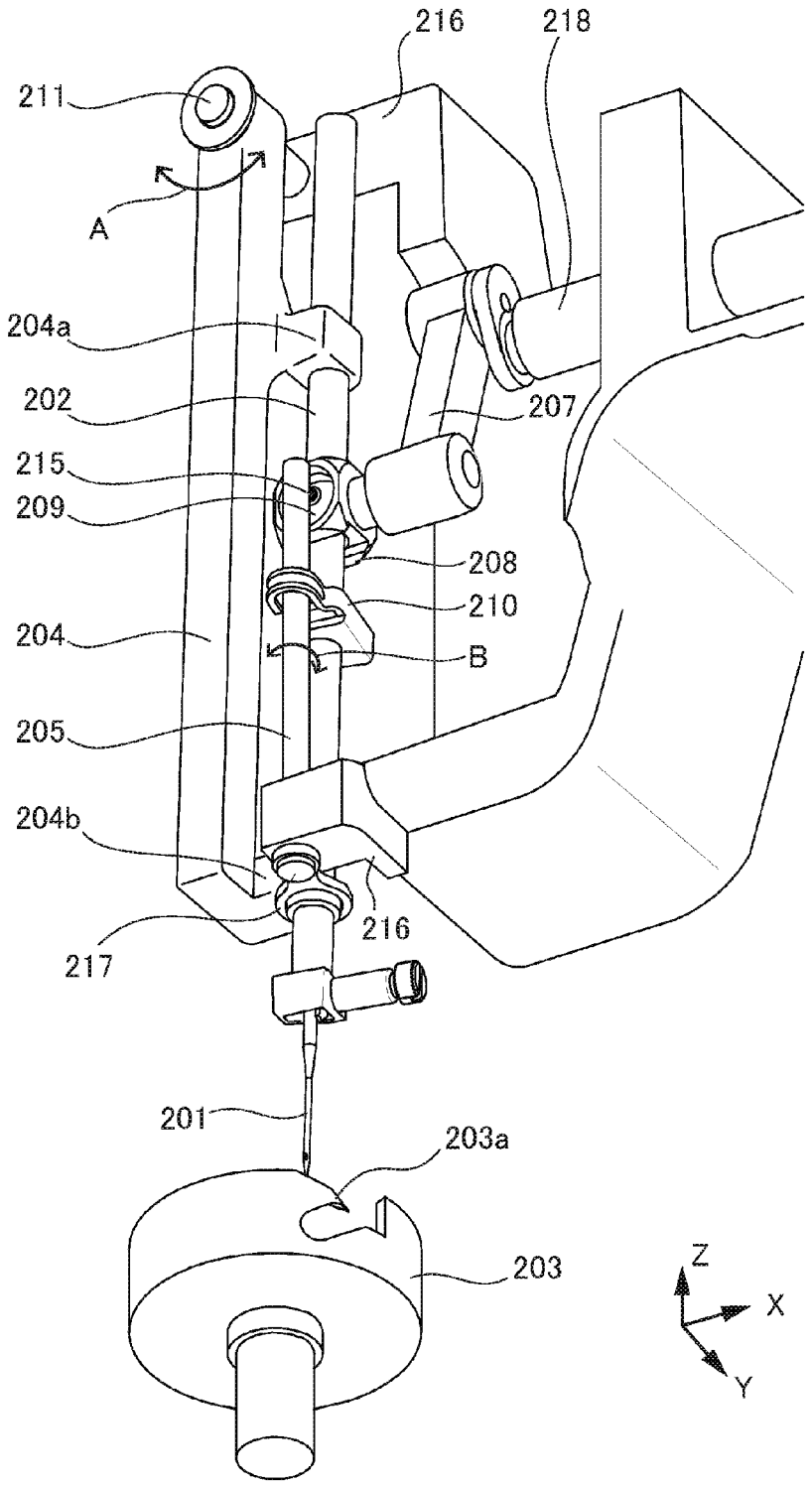
FIG. 24 is a perspective view showing principal components of the needle bar turning apparatus included in the sewing machine 200.

FIG. 24 is a perspective view showing principal components of the needle bar turning apparatus included in the sewing machine 200.

Figure 25:
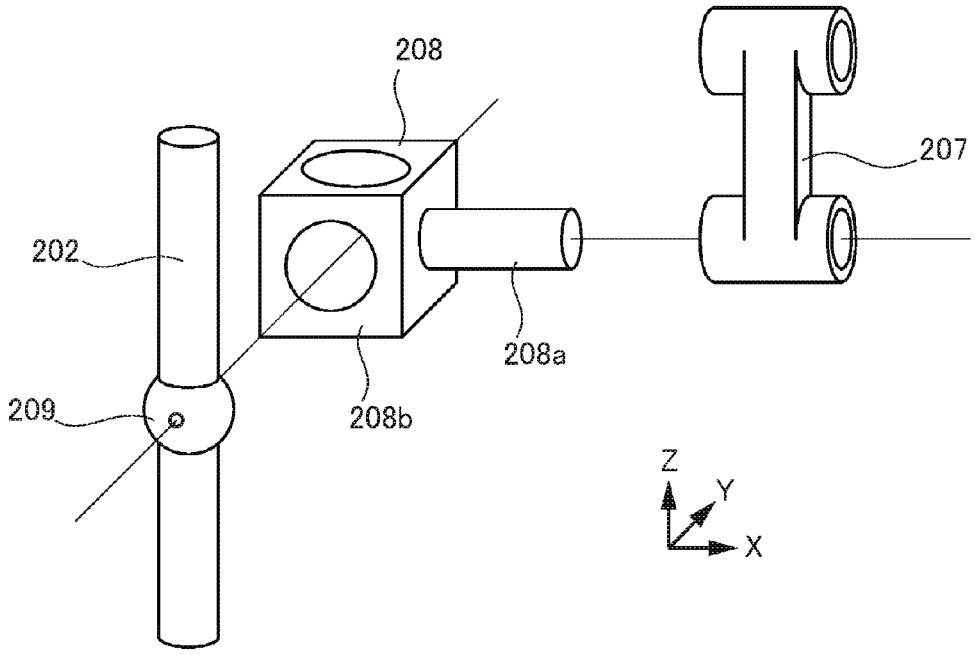
FIG. 25 is an exploded perspective view showing the needle bar connecting bracket 208 and the peripheral areas thereof.

FIG. 25 is an exploded perspective view showing the needle bar connecting bracket 208 and the peripheral areas thereof.

As shown in FIG. 24, the needle bar holder 204 is held with the needle bar holder pin 211 provided on an end of the positive side in the Z-axis direction as a fulcrum point such that it can be swung in the manner of a pendulum with the fulcrum point thus set as the center of rotation.

The needle bar holder 204 is connected to the swing rod 206 (see FIG. 23). However, in FIG. 24, the swing rod 206 is not shown for ease of understanding of the other components.

The needle bar holder 204 holds the needle bar 202 via holding portions 204*a* and 204*b* such that the needle bar 202 can be turned and such that the needle bar 202 can be moved in the axial direction.

The needle bar 202 is held by the needle bar holder 204 such that it can slide in its axial direction and such that it can turn with its axis as the center of rotation. This allows the needle bar 202 to be swung together with the needle bar holder 204. The needle 201 is mounted on a negative side of the needle bar 202 in the Z-axial direction.

The guide shaft 205 is fixed to a sewing machine main body 216 such that it extends along the needle bar 202. Here, description has been made regarding an arrangement in which the guide shaft 205 is arranged such that it extends along the needle bar 202. However, because the needle bar 202 swings, the guide shaft 205 and the needle bar 202 are not necessarily in parallel with each other.

The needle bar coupling portion 209 is fixed to the needle bar 202 by means of a screw 215. The needle bar coupling portion 209 is formed to have a spherical external surface, except for a part thereof configured as a through opening through which the needle bar 202 is to be passed.

The needle bar connecting bracket 208 includes a shaft portion 208*a* and a coupling portion 208*b*.

The shaft portion 208*a* is inserted into the crank rod 207 such that it can slide. The shaft portion 208*a* receives the driving force from the crank rod 207 in synchronization with the rotation of the upper shaft 218, which moves the needle bar connecting bracket 208 along the Z axis in a reciprocating manner.

The coupling portion 208*b* is formed such that its inner face adjoins the spherical structure of the needle bar coupling portion 209, which allows the coupling portion 208*b* to be coupled with the needle bar coupling portion 209 fixed to the needle bar 202. With such an arrangement, the coupling portion 208*b* does not regulate the turning of the needle bar 202 with its axis as the center of rotation. That is, such an arrangement allows the needle bar connecting bracket 208 to transmit a force to the needle bar coupling portion 209 along the axis of the needle bar 202, with a degree of freedom that allows the needle bar 202 to turn with its axis as the center of rotation. Furthermore, by coupling the coupling portion 208*b* with the needle bar coupling portion 209 via such a spherical structure, such an arrangement is capable of absorbing the relative change in the angle between the crank rod 207 and the needle bar 202 that occurs when the needle bar 202 is swung.

It should be noted that FIG. 25 shows the coupling portion 208*b* configured as a single block. However, in order to allow the coupling portion 208*b* to be coupled with the needle bar coupling portion 209 fixed to the needle bar 202, the coupling portion 208*b* is configured such that it can be divided into multiple portions. That is, the coupling portion 208*b* can be assembled by combining such multiple portions by means of unshown screws or the like, for example.

Figure 26:
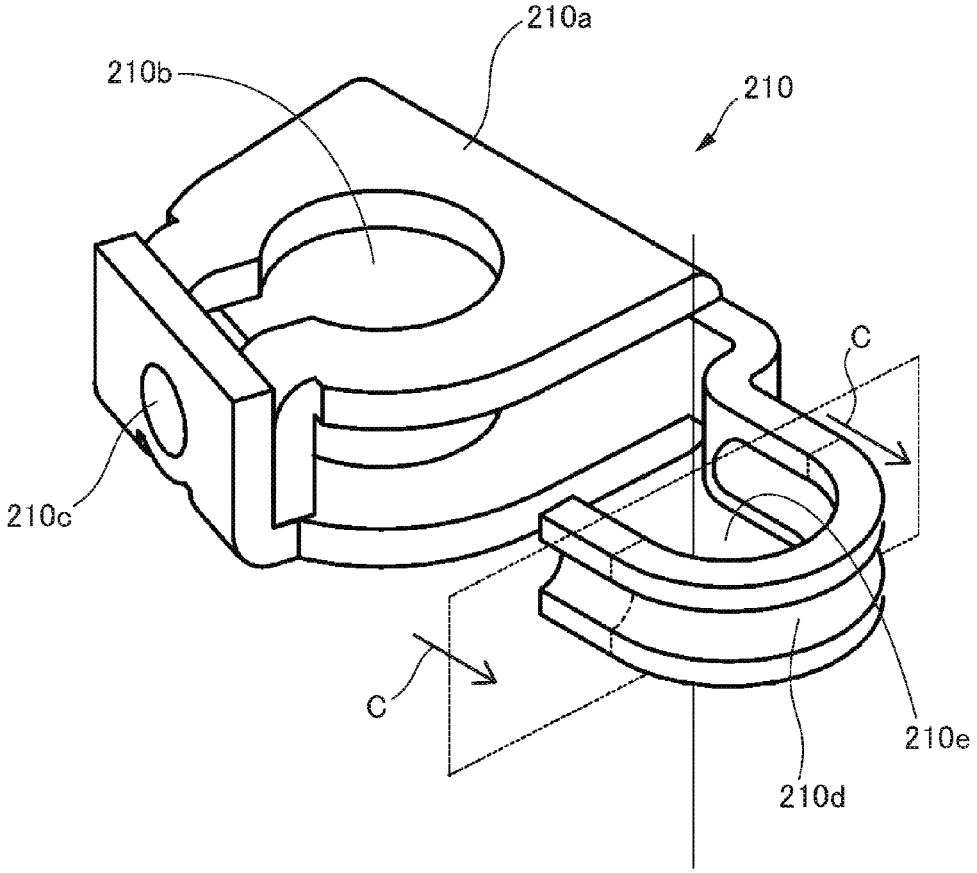
FIG. 26 is a perspective view showing the needle bar guide plate 210.

FIG. 26 is a perspective view showing the needle bar guide plate 210.

Figure 27:
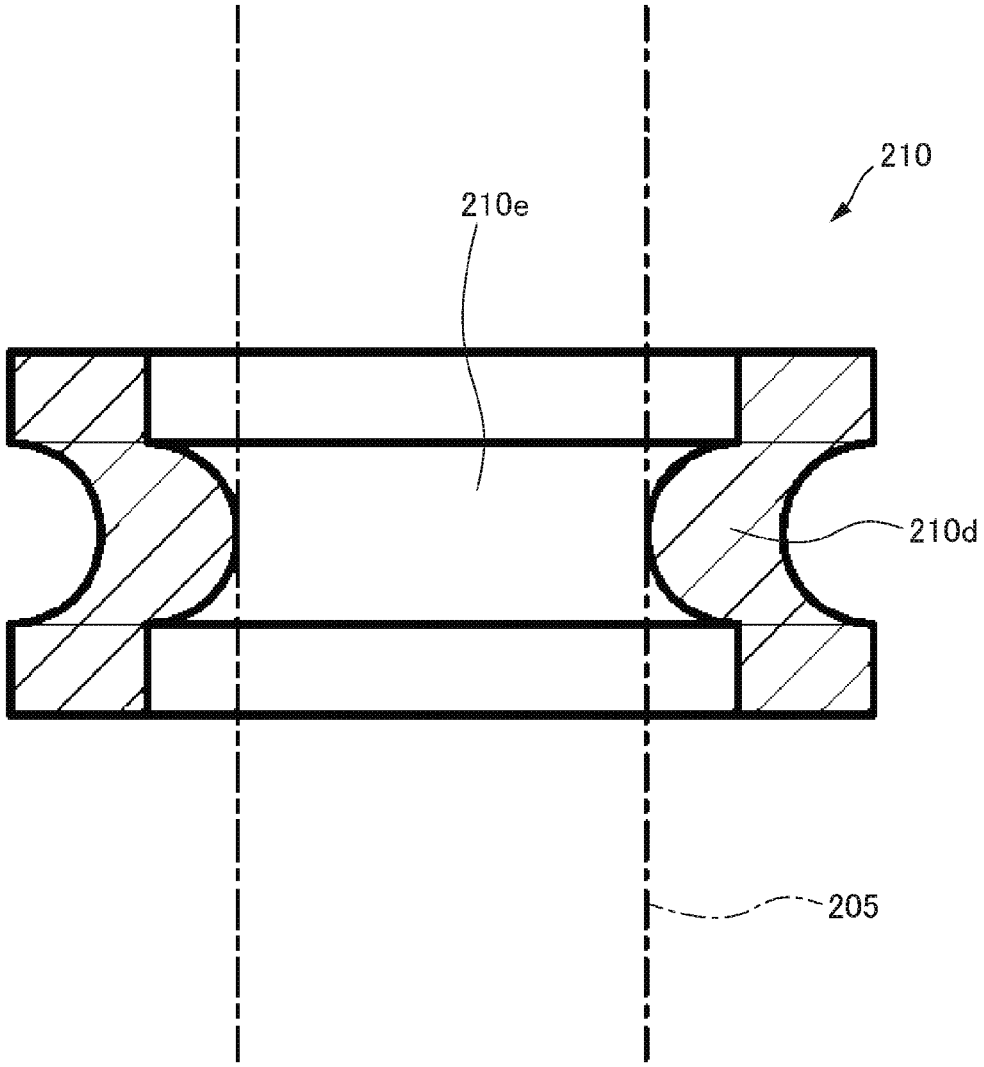
FIG. 27 is a cross-sectional view of the needle bar guide plate 210 taken along a plane indicated by the arrows C shown in FIG. 26.

FIG. 27 is a cross-sectional view of the needle bar guide plate 210 taken along a plane indicated by the arrows C shown in FIG. 26.

As shown in FIG. 26, the needle bar guide plate (needle bar guide member) 210 includes a fixing portion 210*a* and a coupling portion 210*d*.

The fixing portion 210*a* is provided with a fitting opening 210*b*. The needle bar 202 is fitted to the fitting opening 210*b*. By inserting an unshown screw into a screw hole 210*c*, the fixing portion 210*a* is fixed to the needle bar 202 at a distance from the needle bar coupling portion 209 along the axis of the needle bar 202.

As shown in FIG. 27, the coupling portion 210*d* is configured to have a semicircular cross-sectional shape that protrudes toward the inner side. The coupling portion 210*d* is coupled with the guide shaft 205 such that the guide shaft 205 is interposed between the protruding semicircular portions of the coupling portion 210*d*. This allows the coupling portion 210*d* to be coupled with the guide shaft 205 such that the coupling portion 210*d* can be turned with the guide shaft 205 as the center of rotation with a degree of freedom that allows it to be relatively tilted with respect to the guide shaft 205. In addition, the coupling portion 210*d* is coupled with the guide shaft 205 such that the guide shaft 205 is interposed between the semicircular portions of the coupling portion 210*d* arranged on the left side and the right side in the X direction. Thus, even if the distance between the coupling portion 210*d* and the guide shaft 205 has changed in the Y direction, such an arrangement is capable of absorbing such a change in the distance. Thus, the needle bar guide plate 210 is capable of absorbing the relative tilting of the needle bar 202 with respect to the guide shaft 205 and of absorbing the change in the axial distance between the needle bar 202 and the guide shaft 205 that occurs due to circular swinging obtained by combining the swinging indicated by the arrow A and the swinging indicated by the arrow B. Furthermore, with such an arrangement, the needle bar guide plate 210 is capable of regulating the swinging range of the needle bar 202 to be swung along a circle with the guide shaft 205 as its center.

Next, description will be made regarding a reason why the needle bar 202 is to be turned.

Figure 28:
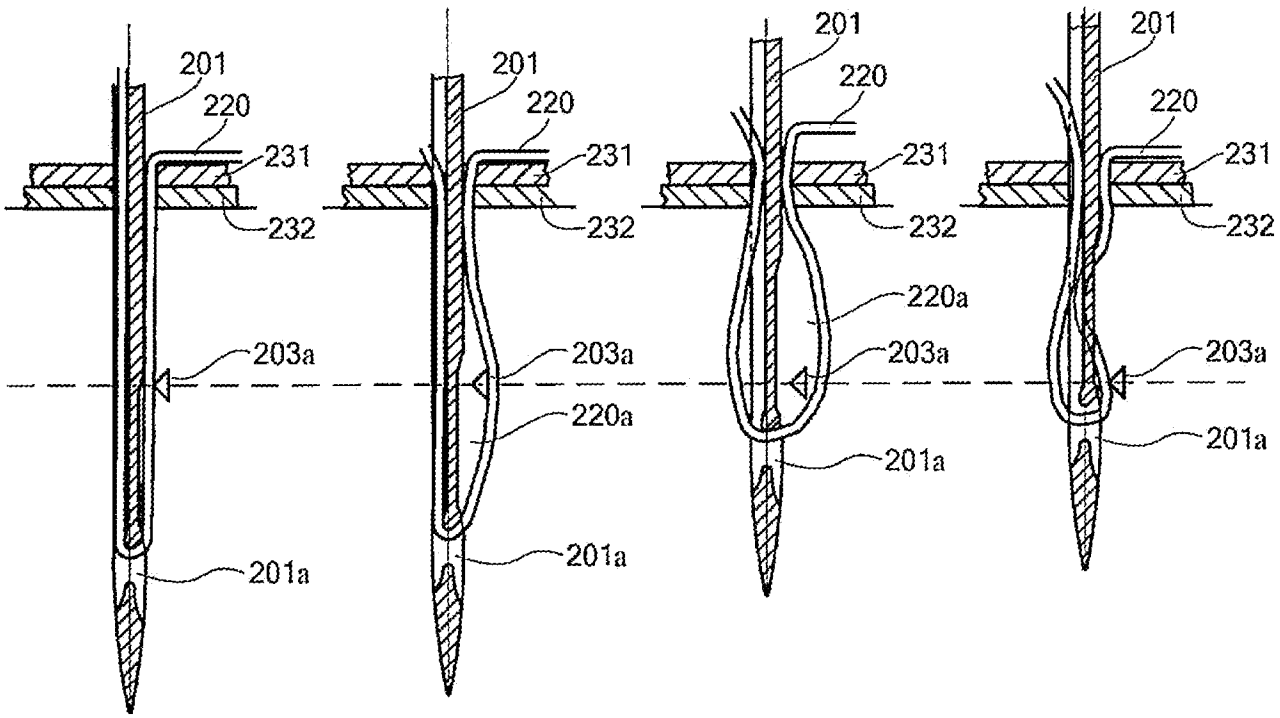
FIG. 28 is a diagram showing a sequence of steps for forming a seam by means of a sewing machine. Each step shows the relation between a thread and the edge of the rotating hook at the corresponding needle position.

FIG. 28 is a diagram showing a sequence of steps for forming a seam by means of a sewing machine. Each step shows the relation between a thread and the edge of the rotating hook at the corresponding needle position. It should be noted that the formation of a seam described with reference to FIG. 28 is by no means unique to the present invention. Rather, typical sewing machines also provide such a formation of a seam as shown in FIG. 28.

FIG. 28 shows a formation of a seam when fabrics 231 and 232 are sewn to each other using an upper thread 220. FIG. 28 shows, in the following order beginning from the left to the right, an operation in which the needle 201 is moved upward. In this operation, in the second and third views from the left side, a thread loop 220*a* is formed. The edge 203*a* is moved such that it passes through the thread loop 220*a*. In this stage, the upper thread is caught by the edge 203*a*, thereby forming a seam. As described above, in order to allow the sewing machine to form a seam, the edge 203*a* is required to pass through the thread loop 220*a* having a very small size. Accordingly, if the thread loop 220*a* is formed with an insufficient size, in some cases, the sewing machine fails to form a seam, which is a problem.

Figure 29:
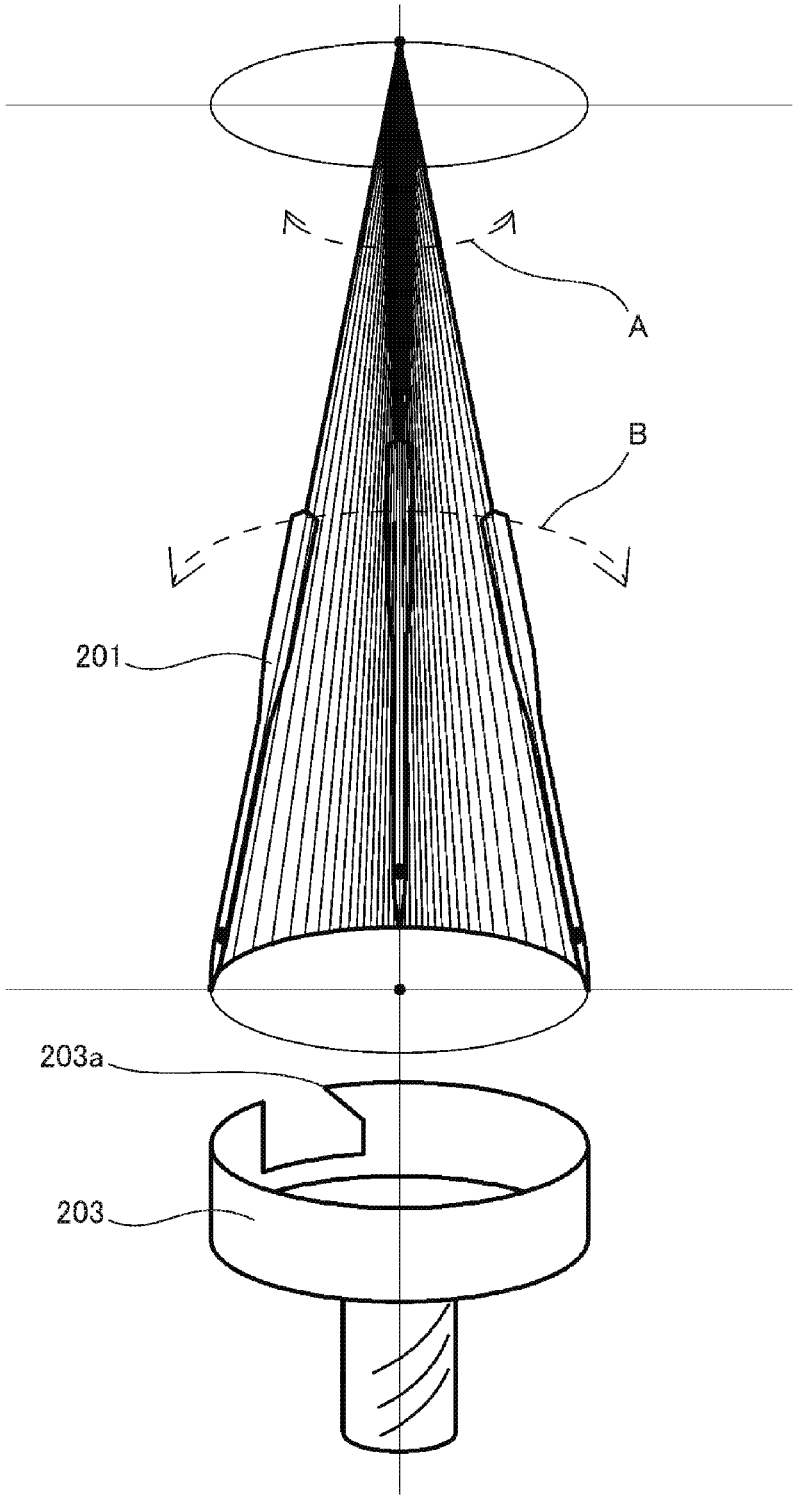
FIG. 29 is a diagram showing a trajectory of the needle 201 when the needle bar is swung in the manner of a pendulum as with the needle bar turning apparatus according to the present embodiment.

FIG. 29 is a diagram showing a trajectory of the needle 201 when the needle bar is swung in the manner of a pendulum as with the needle bar turning apparatus according to the present embodiment.

The guide shaft 205 regulates the swinging range of the needle bar 202. Thus, the needle 201 is moved along a trajectory defined by a conical plane as shown in FIG. 29.

Figure 30:
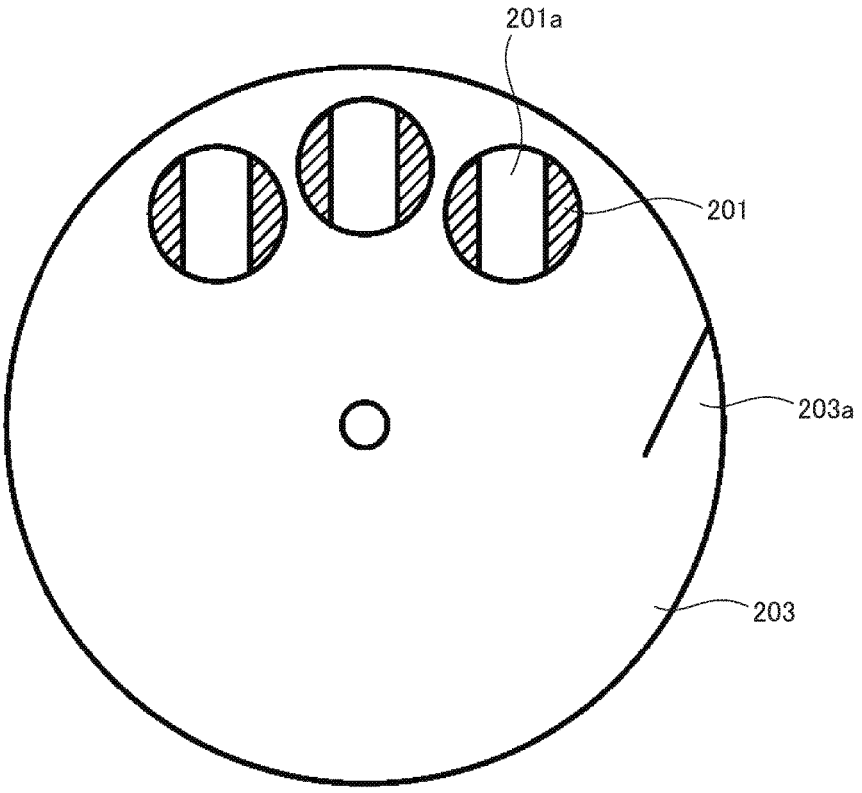
FIG. 30 is a diagram showing a relation between the needle opening 201*a* and the edge 203*a* in a case in which the needle bar 202 is swung without turning.

FIG. 30 is a diagram showing a relation between the needle opening 201*a* and the edge 203*a* in a case in which the needle bar 202 is swung without turning.

In a case in which the needle bar 202 is not turned, the orientation of the needle opening 201*a* is maintained. Accordingly, at both sides of the swinging range of the needle 201, the needle opening 201*a* does not face the center of rotation of the rotating hook 203. In this state, in a case in which the needle bar 202 is not turned, when the thread loop 220*a* is to be caught by the edge 203*a*, the edge 203*a* is inserted into the thread loop 220*a* in a state in which they are tilting with respect to each other. In this case, as viewed along a direction in which the edge 203*a* is inserted, the effective area of the thread loop 220*a* becomes small. Thus, with such a conventional technique, such an arrangement has a problem of a poor probability of the thread loop 220*a* being correctly caught by the edge 203*a*.

Figure 31:
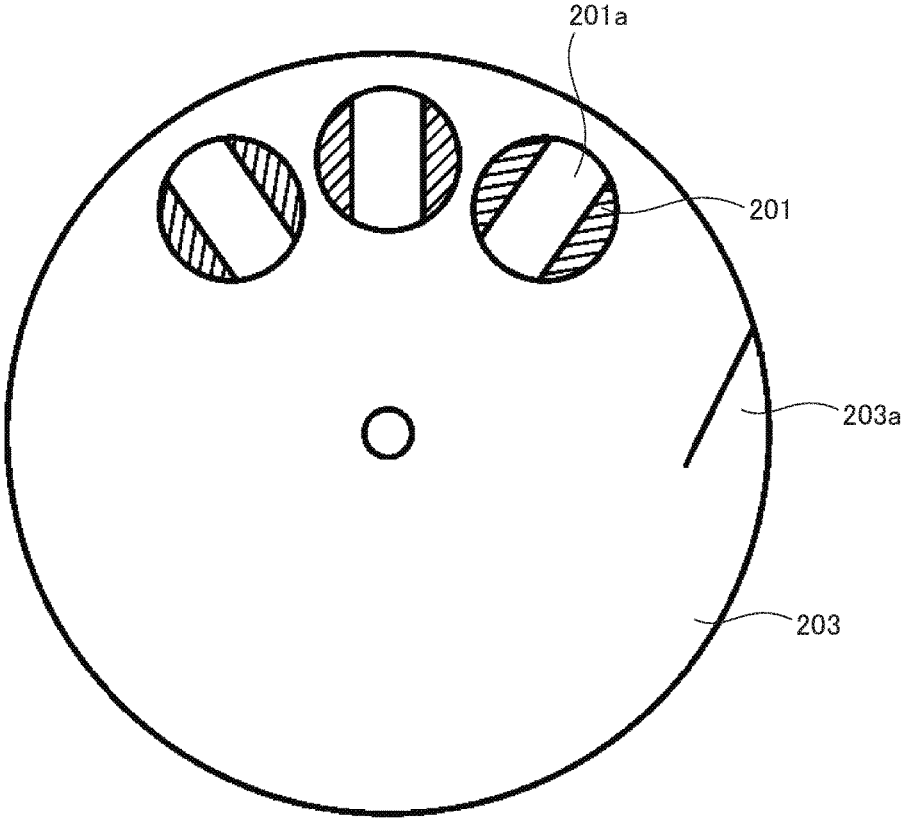
FIG. 31 is a diagram showing a relation between the needle opening 201*a* and the edge 203*a* in the sewing machine 200 including the needle bar turning apparatus according to the present embodiment configured to swing the needle bar 202 while turning the needle bar 202.

FIG. 31 is a diagram showing a relation between the needle opening 201*a* and the edge 203*a* in the sewing machine 200 including the needle bar turning apparatus according to the present embodiment configured to swing the needle bar 202 while turning the needle bar 202.

With the present embodiment, the needle bar turning apparatus described above allows the needle opening 201*a* to face the center of rotation of the rotating hook 203 at all times. Accordingly, such an arrangement is capable of preventing the edge 203*a* from tilting with respect to the thread loop 220*a* when the edge 203*a* is to be inserted into the thread loop 220*a*. Thus, with such an arrangement, the probability of the thread loop 220*a* being caught by the edge 203*a* is the same as that provided in a case in which the needle bar 202 is not swung.

As described above, with the sewing machine 200 according to the present embodiment, by providing the needle bar coupling portion 209 having a spherical structure, such an arrangement provides the needle bar 202 with an improved degree of freedom of the rotational direction around its axis. Furthermore, the needle bar guide plate 210 is provided so as to regulate the turning of the needle bar 202. With such an arrangement, when the needle bar 202 is swung such that it forms an arc-shaped trajectory, the relative position relation between the guide shaft 205 and the needle bar 202 changes, which turns the needle bar 202. This allows the needle opening 201*a* to face the center of the rotating hook at all times.

Furthermore, in the sewing machine 200, the needle bar guide plate 210 includes the coupling portion 210*d* protruding in a semicircular shape. The guide shaft 205 is coupled with the coupling portion 210*d* such that the guide shaft 205 is interposed between both sides of the semicircular protruding portion. Such an arrangement requires only a simple and compact-size configuration to absorb relative tilting between the needle bar 202 and the guide shaft 205 and to absorb a change in the axial distance between them.

Thus, the present embodiment provides a sewing machine having a simple configuration that can be designed with a compact size in a simple manner.

Furthermore, the present embodiment provides a sewing machine having a pendulum type needle swinging mechanism that allows the needle bar to be turned according to the swinging of the needle.

Third Embodiment

Figure 32:
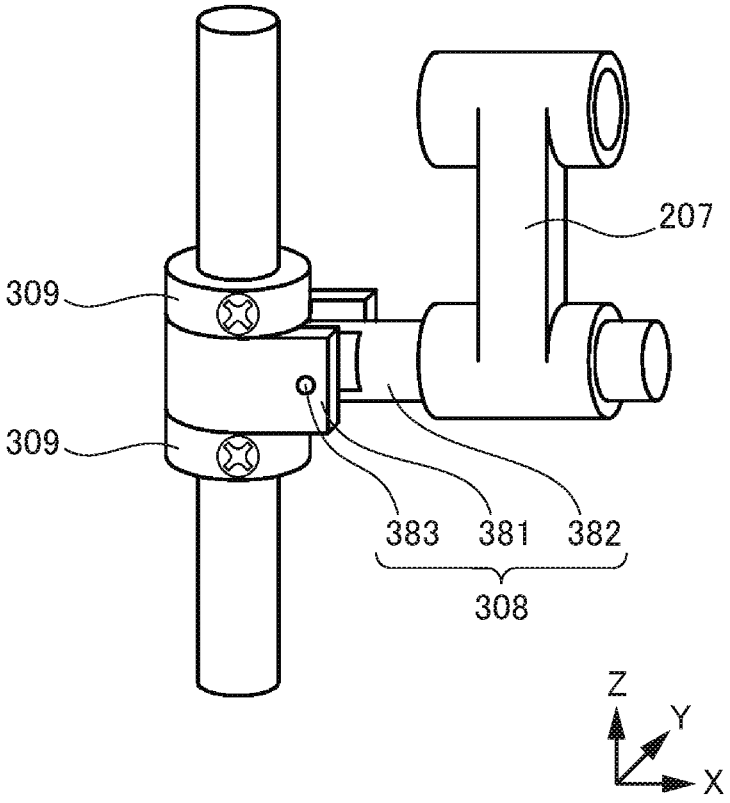
FIG. 32 is a perspective view showing a needle bar connecting bracket 303 and the peripheral areas thereof according to a third embodiment.

FIG. 32 is a perspective view showing a needle bar connecting bracket 308 and the peripheral areas thereof according to a third embodiment.

Figure 33:
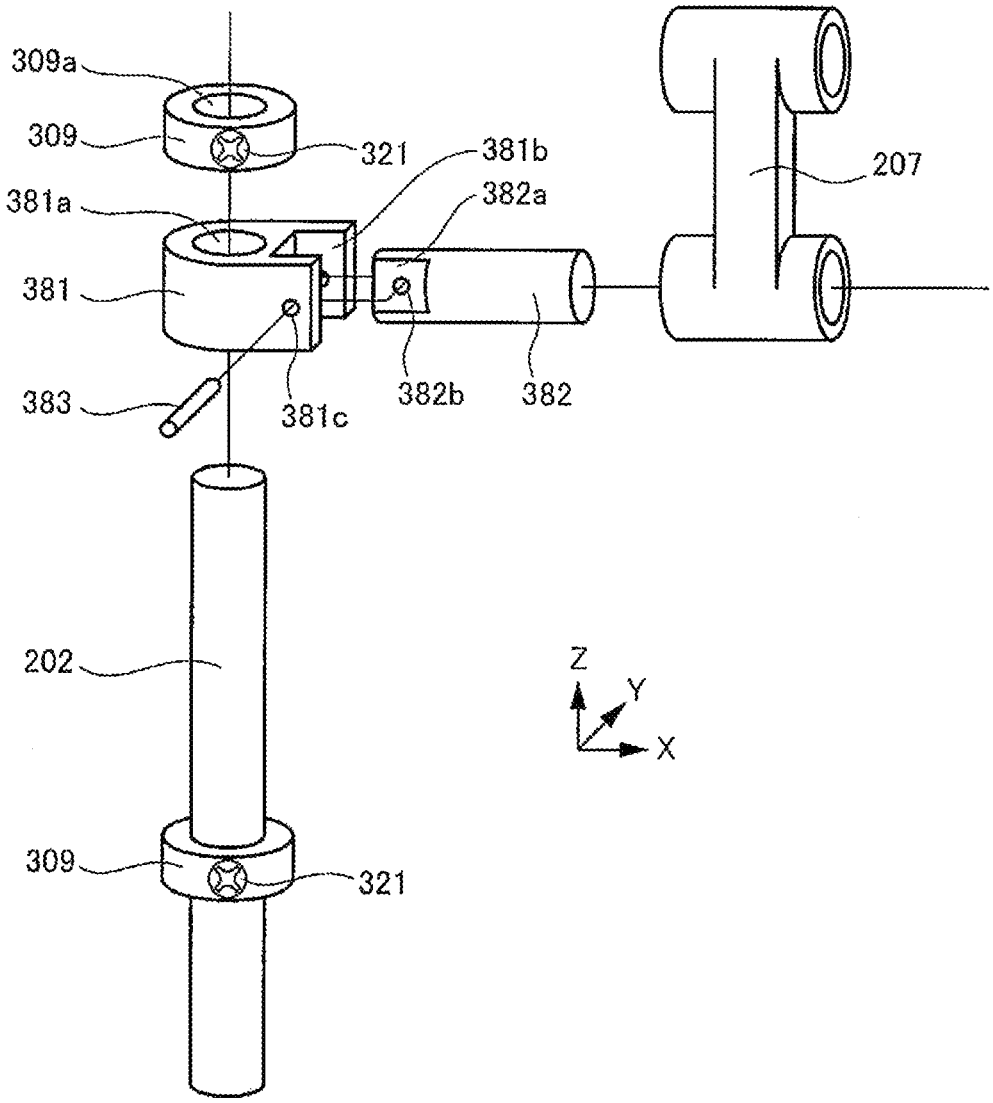
FIG. 33 is an exploded perspective view showing the needle bar connecting bracket 308 and the peripheral areas thereof according to the third embodiment.

FIG. 33 is an exploded perspective view showing the needle bar connecting bracket 308 and the peripheral areas thereof according to the third embodiment.

A needle bar turning apparatus according to the third embodiment has the same configuration as that of the second embodiment except for the configuration of a needle bar connecting bracket 308 and a needle bar coupling portion 309. Accordingly, each component of the third embodiment providing the same function as that provided by the second embodiment is denoted by the same reference symbol, and redundant description will be omitted as appropriate.

As shown in FIG. 32, a pair of needle bar coupling portions 309 are provided, which are each fixed to the needle bar 202 by a screw 21. Each needle bar coupling portion 309 is configured as a ring-shaped member having a through opening 309*a* at its center so as to allow the needle bar 202 to pass through.

The needle bar connecting bracket 308 is configured as a combination of a base portion 381, a shaft portion 382, and a pin 383.

The needle bar 202 is fitted to the base portion 381 in a state in which the needle bar 202 is slidably inserted into a fitting opening 381*a*. Furthermore, the base portion 381 is arranged such that it is interposed between the needle bar coupling portions 309 along the vertical direction in this drawing. That is, the base potion 381 is engaged with both the pair of needle bar coupling portions 309. Such an arrangement allows the movement of the base potion 381 in the vertical direction (Z-axis direction) to be transmitted to the needle bar 202. With such an arrangement, the base portion 381 does not regulate the rotation of the needle bar 202 with its axis as the center of rotation. That is, the rotation of the needle bar 202 is not regulated by the base portion 381 with its axis as the center of rotation. The base portion 381 is provided with a connecting portion 381*b* formed such that a connecting portion 382*a* of the shaft portion 382 is interposed between both sides of the connecting portion 381*b*. A pin opening 381*c* is formed in the connecting portion 381*b*.

As shown in FIG. 33, the shaft portion 382 has the connecting portion 382*a* on one side thereof, which is connected to the connecting portion 381*b* of the base portion 381. The other side of the shaft portion 382 is inserted into the crank rod 207. A pin opening 382*b* is formed in the connecting portion 382*a*.

The pin 383 is inserted into the pin opening 381*c* and the pin opening 382*b*, which ensures that the pin 383 is arranged such that it extends in a direction that is orthogonal to the axis of the needle bar 202. Thus, the shaft portion 382 is connected to the base portion 381 such that it can be turned with the pin 383 as the center of rotation. As described above, by allowing the shaft portion 382 to turn with respect to the base portion 381, such an arrangement is capable of absorbing a relative change in the angle between the crank rod 207 and the needle bar 202 that occurs when the needle bar 202 is swung.

As described above, in the third embodiment, the needle bar connecting bracket 308 is configured as a combination of the base portion 381, the shaft portion 382, and the pin 383. Such an arrangement is capable of providing the same function as that provided by the second embodiment, without employing such a spherical contact member as described in the second embodiment. In the present embodiment, the needle bar connecting bracket 308 and the pair of needle bar coupling portions 309 are each configured as a combination of multiple components having a simple structure that can be easily manufactured as compared with such a spherical structure as described in the second embodiment. This allows the sewing machine according to the present embodiment to be manufactured in a simpler manner.

The present invention is not restricted to the embodiments described above. Rather, various changes and modifications may be made, which are encompassed within the technical scope of the present invention.

For example, in the embodiment of the present invention, both the two centers of rotation described later are set to the same axis (guide shaft 5 or 205). Also, depending on the design layout of the components, there may be a slight difference between the center of rotation of the holder guide plate (17 or 217) and the center of rotation (of the connecting member 9 or the needle guide plate 210) that is required to allow the needle opening 1*a* to face the center of the rotating hook with high precision. When the needle 1 is swung and turned, in some cases, it cannot be said that such an arrangement results in a situation in which the orientation of the needle opening 1*a* and the center of the rotating hook match each other in the strict sense. However, such a difference between the two centers of rotation is very small, which leads to only a very small difference between the orientation of the needle opening 1*a* and the center of the rotating hook. Such a very small difference leads to no damage to the substantial effect of the invention. That is, such an arrangement does not necessarily require that the orientation of the needle opening 1*a* strictly matches the center of rotating hook. Rather, such an arrangement requires only a readily obtainable condition in that the needle bar 1 is turned by means of the needle bar turning portion (9 and 10 or 210), which allows the thread loop to be caught by the edge of the rotating hook at all times in the sewing operation.

DESCRIPTION OF THE REFERENCE NUMERALS

1 needle, 1*a* needle opening, 2 needle bar, 3 rotating hook, 4 needle bar holder, 4*a* connection hole, 4*b* holding portion, 4*c* holding portion, 5 guide shaft, 6 swing rod, 7 crank rod, 8 needle bar connecting bracket, 8*a* shaft portion, 8*b* base portion, 8*c* through opening, 9 coupling member, 9*a* through opening, 9*b* base portion, 9*c* extension portion, 9*d* opening, 9*e* opening, 10 guide shaft connecting bracket, 10*a* slot, 11 needle bar holder pin, 12 transmission mechanism, 13 motor, 14 motor, 15 screw, 16 sewing machine main body, 17 holder guide plate, 100 sewing machine, 200 sewing machine, 201 needle, 201*a* needle opening, 202 needle bar, 203 rotating hook, 203*a* edge, 204 needle bar holder, 204*b* holding portion, 205 guide shaft, 206 swing rod, 207 crank rod, 208 needle bar connecting bracket, 208*a* shaft portion, 208*b* coupling portion, 209 needle bar coupling portion, 210 needle bar guide portion (plate), 210*a* fixing portion, 210*b* fitting opening, 210*c* hole, 210*d* coupling portion, 211 needle bar holder pin, 212 transmission mechanism, 213 motor, 214 motor, 215 screw, 216 sewing machine main body, 217 holder guide plate, 218 upper shaft, 219 lower shaft, 220 upper thread, 220*a* thread loop, 231 fabric, 232 fabric, 308 needle bar connecting bracket, 309 needle bar coupling portion, 309*a* through opening, 381 base portion, 381*a* fitting opening, 381*b* connecting portion, 381*c* pin opening, 382 shaft portion, 382*a* connecting portion, 382*b* pin opening, 383 pin.

What is claimed is:

1. A sewing machine comprising a needle bar turning apparatus, wherein the needle bar turning apparatus comprises:

a needle bar holder held such that it can be swung along a conical plane with a fulcrum point provided to a sewing machine main body as a center of rotation;

a swing rod that is connected to the needle bar holder, and that transmits a driving force so as to swing the needle bar holder;

a needle bar that is configured as a bar-shaped member, that is held by the needle bar holder such that it can slide along an axis of the bar-shaped member and such that it can turn with the aforementioned axis as a center of rotation, and such that it can be swung together with the needle bar holder;

a guide shaft arranged such that it extends along the needle bar; and a needle bar turning portion that is arranged such that one end thereof is fixed to the needle bar and the other end thereof can be turned with the guide shaft as a center of rotation, and that turns the needle bar with the aforementioned axis as a center of rotation according to swinging of the needle bar holder.

2. A sewing machine comprising a needle bar turning apparatus, wherein the needle bar turning apparatus comprises:

a needle bar holder held such that it can be swung, with a fulcrum point provided to a main body of the sewing machine as a center of rotation;

a swing rod that is connected to the needle bar holder, and that transmits a driving force that swings the needle bar holder;

a needle bar held by the needle bar holder such that it can be slid in an axial direction thereof and such that it can be turned with an axis thereof as a center of rotation, and configured to be swung together with the needle bar holder;

a coupling member that is fixed to the needle bar, and that is arranged such that it extends in a direction that is orthogonal to the needle bar;

a guide shaft arranged such that it extends along the needle bar; and a guide shaft connecting bracket fitted to the coupling member and the guide shaft such that it can be moved relative to the coupling member in a direction in which the coupling member extends, and such that it can be turned relative to the coupling member with a virtual line that extends in the extension direction as a center of rotation.

3. The sewing machine comprising the needle bar turning apparatus according to claim 2, wherein the needle bar holder is configured such that position adjustment can be made for the fulcrum point in a direction in which the swinging central axis extends, and wherein a margin is provided to a fitting portion that connects the coupling member and the guide shaft connecting bracket so as to absorb an angle of tilting that occurs between the guide shaft and the needle bar due to the position adjustment of the fulcrum point.

4. The sewing machine comprising the needle bar turning apparatus according to claim 3, comprising a needle bar connecting bracket that is engaged with a crank rod that transmits a driving force that drives the needle bar in the axial direction, wherein the needle bar connecting bracket is arranged such that it is engaged with the coupling member, wherein a margin is provided to a gap between the needle bar connecting bracket and the needle bar so as to absorb a tilting of the needle bar, and wherein the needle bar connecting bracket and the coupling member are configured such that they do not interfere with each other due to swinging of the coupling member with the guide shaft as a center of rotation.

5. The sewing machine comprising the needle bar turning apparatus according to claim 2, comprising a needle bar connecting bracket that is engaged with a crank rod that transmits a driving force that drives the needle bar in the axial direction, wherein the needle bar connecting bracket is arranged such that it is engaged with the coupling member, wherein a margin is provided to a gap between the needle bar connecting bracket and the needle bar so as to absorb a tilting of the needle bar, and wherein the needle bar connecting bracket and the coupling member are configured such that they do not interfere with each other due to swinging of the coupling member with the guide shaft as a center of rotation.

6. A sewing machine comprising a needle bar turning apparatus, wherein the needle bar turning apparatus comprises:

a needle bar holder held such that it can be swung with a fulcrum point provided to a sewing machine main body as a center of rotation;

a swing rod that is connected to the needle bar holder, and that transmits a driving force so as to swing the needle bar holder;

a needle bar that is configured as a bar-shaped member, that is held by the needle bar holder such that it can slide along an axis of the bar-shaped member and such that it can turn with the aforementioned axis as a center of rotation, and that can be swung together with the needle bar holder;

a crank rod that transmits a driving force so as to drive the needle bar in the axial direction;

a needle bar connecting bracket that is engaged with the crank rod;

a needle bar coupling portion that is fixed to the needle bar, that is coupled with the needle bar connecting bracket in a state that allows the needle bar coupling portion and the needle bar to turn with the axis of the needle bar as a center of rotation, and that receives the driving force from the needle bar connecting bracket so as to drive the needle bar in the axial direction;

a guide shaft arranged such that it extends along the needle bar; and a needle bar guide portion comprising a fixing portion fixed to the needle bar, and a coupling portion coupled with the guide shaft such that it can be turned with the guide shaft as a center of rotation with a degree of freedom that allows it to relatively tilt with respect to the guide shaft.

7. The sewing machine comprising the needle bar turning apparatus according to claim 6, wherein the coupling portion of the needle bar guide portion comprises a protruding portion having a semicircular cross-sectional shape, which is coupled with the guide shaft.

8. The sewing machine comprising the needle bar turning apparatus according to claim 7, wherein the needle bar coupling portion includes at least a portion having a spherical structure, and wherein the needle bar connecting bracket is coupled with the spherical structure of the needle bar coupling portion.

9. The sewing machine comprising the needle bar turning apparatus according to claim 7, wherein the needle bar coupling portion is configured as a combination of two ring-shaped members each of which allows the needle bar to be inserted, and wherein the needle bar connecting bracket is arranged between the two ring-shaped members, so as to be engaged with each of the two ring-shaped members.

10. The sewing machine comprising the needle bar turning apparatus according to claim 6, wherein the needle bar coupling portion includes at least a portion having a spherical structure, and wherein the needle bar connecting bracket is coupled with the spherical structure of the needle bar coupling portion.

11. The sewing machine comprising the needle bar turning apparatus according to claim 6, wherein the needle bar coupling portion is configured as a combination of two ring-shaped members each of which allows the needle bar to be inserted, and wherein the needle bar connecting bracket is arranged between the two ring-shaped members, so as to be engaged with each of the two ring-shaped members.

* * * * *